US007936240B2

(12) United States Patent
Lee et al.

(10) Patent No.: US 7,936,240 B2
(45) Date of Patent: May 3, 2011

(54) LITHOGRAPHICALLY CONTROLLED CURVATURE FOR MEMS DEVICES AND ANTENNAS

(75) Inventors: Sae Won Lee, Burnaby (CA); Daniel Elliot Sameoto, Vancouver (CA); Meenakshinathan Ash Parameswaran, Coquitlam (CA); Alireza Mahanfar, Vancouver (CA); Rodney Grant Vaughan, Burnaby (CA)

(73) Assignee: Simon Fraser University, Burnaby, British Columbia (CA)

( * ) Notice: Subject to any disclaimer, the term of this patent is extended or adjusted under 35 U.S.C. 154(b) by 367 days.

(21) Appl. No.: 12/189,782

(22) Filed: Aug. 11, 2008

(65) Prior Publication Data

US 2009/0046018 A1 Feb. 19, 2009

Related U.S. Application Data

(60) Provisional application No. 60/964,814, filed on Aug. 16, 2007.

(51) Int. Cl.
*H01H 51/22* (2006.01)

(52) U.S. Cl. ..... 335/78; 200/181

(58) Field of Classification Search ..... 335/78; 200/200

See application file for complete search history.

(56) References Cited

U.S. PATENT DOCUMENTS 6,101,371 A 8/2000 Barber et al.
6,127,908 A * 10/2000 Bozler et al. ..... 333/246
6,191,671 B1 * 2/2001 Schlaak et al. ..... 335/78
6,271,802 B1 8/2001 Clark et al.
6,392,524 B1 5/2002 Biegelsen et al.
6,625,004 B1 * 9/2003 Musolf et al. ..... 361/278
6,731,492 B2 * 5/2004 Goodwin-Johansson .... 361/233
7,000,315 B2 2/2006 Chua et al.
7,053,737 B2 * 5/2006 Schwartz et al. ..... 335/78
7,133,185 B2 11/2006 Wen et al.
7,196,599 B2 * 3/2007 Dabbaj ..... 335/78
7,372,348 B2 * 5/2008 Xu et al. ..... 335/78
7,453,339 B2 * 11/2008 Fork et al. ..... 335/78
7,498,715 B2 * 3/2009 Yang ..... 310/309
2007/0024506 A1 2/2007 Hardacker

OTHER PUBLICATIONS

P. J. French and P. M. Sarro, "Surface versus bulk micromachining: the contest for suitable applications," J. Micromech. Microeng, vol. 8, pp. 45-53, 1998.

(Continued)

*Primary Examiner* — Elvin G Enad
*Assistant Examiner* — Bernard Rojas
(74) *Attorney, Agent, or Firm* — Oyen Wiggs Green & Mutala LLP

(57) ABSTRACT

Lithographically fabricated apparatus are provided. The apparatus are capable of self-assembly to extend at least in part in an out-of-plane direction. A cantilever arm is anchored to a substrate at one of its ends and fabricated to provide a cantilever portion that extends from the anchor in a longitudinal direction generally parallel to the substrate, One or more posts are fabricated atop the cantilever portion. The posts shrink from a first volume to a second volume, less than the first volume, during fabrication thereof. The change in volume of the post from the first volume to the second volume causes stress between the post and the cantilever arm resulting in the cantilever portion bending from an in-plane orientation extending in the longitudinal direction to a self-assembled orientation extending at least in part in an out-of-plane direction away from the substrate.

51 Claims, 14 Drawing Sheets

OTHER PUBLICATIONS

B. Kloeck, S. D. Collins, N. F. de Rooij, and R. L. Smith, "Study of electrochemical etch-stop for high-precision thickness control of silicon membranes," Electron Devices, IEEE Transactions on, vol. 36, pp. 663-669, 1989.
W. P. Eaton and J. H. Smith, "Micromachined pressure sensors: review and recent developments," Smart Materials and Structures, vol. 6, pp. 530-539, 1997.
H. T. G. van Lintel, F. C. M. van de Pol, and S. Bouwstra, "A piezoelectric micropump based on micromachining of silicon," Sensors and Actuators, vol. 15, pp. 153-167, 1988.
S. Sedky, A. Witvrouw, H. Bender, and K. Baert, "Experimental determination of the maximum post-process annealing temperature for standard CMOS wafers," Electron Devices, IEEE Transactions on, vol. 48, pp. 377-385, 2001.
H. Takeuchi, A. Wung, X. Sung, R.T. Howe, and R. King, "Thermal budget limits of quarter-micrometer foundry CMOS for post-processing MEMS devices," Electron Devices, IEEE Transactions on, vol. 52, pp. 2081-2086, 2005.
C. H. Ahn, Y. J. Kim, and M. G. Allen, "A planar variable reluctance magnetic micromotor with fully integrated stator and coils," Microelectromechanical Systems, Journal of, vol. 2, pp. 165-173, 1993.
W. S. N. Trimmer and K. J. Gabriel, "Design considerations for a practical electrostatic micro-motor," Sensors Actuators., vol. 11, pp. 189-206, 1987.
P. B. Chu, S. S. Lee, and S. Park, "MEMS: the path to large optical crossconnects," Communications Magazine, IEEE, vol. 40, pp. 80-87, 2002.
S. H. Tsang, D. Sameoto, I. G. Foulds, R. W. Johnstone, and M. Parameswaran, "Automated assembly of hingeless 90 degrees out-of-plane microstructures," Journal of Micromechanics and Microengineering, vol. 17, pp. 1314-1325, 2007 (published Jun. 5, 2007).
M. H. Kiang, O. Solgaard, K. Y. Lau, and R. S. Muller, "Electrostatic combdrive-actuated micromirrors for laser-beam scanning and positioning," Microelectromechanical Systems, Journal of, vol. 7, pp. 27-37, 1998.
Y. Mizuno, O. Tsuboi, N. Kouma, H. Soneda, H. Okuda, Y. Nakamura, S. Ueda, I. Sawaki, and F. Yamagishi, "A 2-axis comb-driven micromirror array for 3D MEMS switches," Optical MEMs, 2002. Conference Digest. 2002 IEEE/LEOS International Conference on, pp. 17-18, 2002.
V. Kaajakari and A. Lal, "Electrostatic batch assembly of surface MEMS using ultrasonic triboelectricity," in Micro Electro Mechanical Systems, 2001. MEMS 2001. The 14th IEEE International Conference on, 2001, pp. 10-13.
T. Akiyama, D. Collard, and H. Fujita, "Scratch drive actuator with mechanical links for self-assembly of three-dimensional MEMS," Microelectromechanical Systems, Journal of, vol. 6, pp. 10-17, 1997.
L. Buchaillot, O. Millet, E. Quevy and D. Collard, "Post-buckling dynamic behavior of self-assembled 3D microstructures," Microsystem Technologies, vol. 14, pp. 69-78, 2007 (published online Mar. 2007).
E. Quevy, L. Buchaillot, and D. Collard, "3-D self-assembling and actuation of electrostatic microstructures," Electron Devices, IEEE Transactions on, vol. 48, pp. 1833-1839, 2001.
M. J. Sinclair, "A high force low area MEMS thermal actuator," Thermal and Thermomechanical Phenomena in Electronic Systems, 2000. ITHERM 2000. The Seventh Intersociety Conference on, vol. 1, pp. 127-132, 2000.
J. A. Wright, Y. C. Tai, and S. C. Chang, "A large-force, fully-integrated MEMS magnetic actuator," Solid State Sensors and Actuators, 1997. Transducers'97 Chicago., 1997 International Conference on, vol. 2, pp. 793-796, 1997.
R. W. Johnstone, D. Sameoto, and M. Parameswaran, "Non-uniform residual stresses for parallel assembly of out-of-plane surface-micromachined structures," Journal of Micromechanics and Microengineering, vol. 16, pp. N17-N22, 2006 (published Sep. 26, 2006).
G. W. Dahlmann, E. M. Yeatman, P. R. Young, I. D. Robertson, and S. Lucyszyn, "MEMS high Q microwave inductors using solder surface tension self-assembly," in Microwave Symposium Digest, 2001 IEEE MTT-S International, 2001, pp. 329-332 vol. 1.
R. R. A. Syms, "Surface tension powered self-assembly of 3-D micro-optomechanical structures," Microelectromechanical Systems, Journal of, vol. 8, pp. 448-455, 1999.
R. R. A. Syms, C. Gormley, and S. Blackstone, "Improving yield, accuracy and complexity in surface tension self-assembled MOEMS," Sensors and Actuators A: Physical, vol. 88, pp. 273-283, 2001.
R. R. A. Syms, E. M. Yeatman, V. M. Bright, and G. M. Whitesides, "Surface tension-powered self-assembly of microstructures—the state-of-the-art," Microelectromechanical Systems, Journal of, vol. 12, pp. 387-417, 2003.
W. J. Arora, A. J. Nichol, H. I. Smith, and G. Barbastathis, "Membrane folding to achieve three-dimensional nanostructures: Nanopatterned silicon nitride folded with stressed chromium hinges," Applied Physics Letters, vol. 88, pp. 053108-3, 2006 (published Jan. 31, 2006).
C. L. Chua, D. K. Fork, K. Van Schuylenbergh, and Jeng-Ping Lu, "Out-of-plane high-Q inductors on low-resistance silicon," Microelectromechanical Systems, Journal of, vol. 12, pp. 989-995, 2003.
H. J. In, W. J. Arora, P. Stellman, S. Kumar, Y. Shao-Horn, H. I. Smith, and G. Barbastathis, "The nanostructured Origami 3D fabrication and assembly process for nanopatterned 3D structures," in Smart Structures and Materials 2005: Smart Electronics, MEMS, BioMEMS, and Nanotechnology, San Diego, CA, USA, 2005, pp. 84-95.
S. M. Jurga, C. H. Hidrovo, J. Niemczura, H. I. Smith, and G. Barbastathis, "Nanostructured origami," in Nanotechnology, 2003. IEEE-NANO 2003. 2003 Third IEEE Conference on, 2003, pp. 220-223 vol. 2.
L. Lijie, J. Zawadzka, and D. Uttamchandani, "Integrated self-assembling and holding technique applied to a 3-D MEMS variable optical attenuator," Microelectromechanical Systems, Journal of, vol. 13, pp. 83-90, 2004.
T. Ebefors, E. Kalvesten, and G. Stemme, "Three dimensional silicon triple-hot-wire anemometer based on polyimide joints," in Micro Electro Mechanical Systems, 1998. MEMS 98. Proceedings., The Eleventh Annual International Workshop on, 1998, pp. 93-98.
T. Ebefors, E. Kalvesten, and G. Stemme, "Dynamic actuation of polyimide V-groove joints by electrical heating," Sensors and Actuators A: Physical, vol. 67, pp. 199-204, 1998.
T. Ebefors, E. Kalvesten, C. Vieider, and G. Stemme, "New robust small radius joints based on thermal shrinkage of polyimide in V-grooves," in Solid State Sensors and Actuators, 1997. Transducers '97 Chicago., 1997 International Conference on, 1997, pp. 675-678 vol. 1.
T. Ebefors, J. U. Mattsson, E. Kalvesten, and G. Stemme, "A robust micro conveyer realized by arrayed polyimide joint actuators," Journal of Micromechanics and Microengineering, vol. 10, pp. 337-349, 2000.
T. Ebefors, E. Kalvesten, and G. Stemme, "New small radius joints based on thermal shrinkage of polyimide in V-grooves for robust self-assembly 3D microstructures," Journal of Micromechanics and Microengineering, vol. 8, pp. 188-194, 1998.
T. Ebefors, J. Ulfstedt-Mattsson, E. Kaelvesten, and G. Stemme, "3D micromachined devices based on polyimide joint technology," in Device and Process Technologies for MEMS and Microelectronics, Gold Coast, Australia, 1999, pp. 118-132.
J. B. Yoon, Y. S. Choi, B. I. Kim, Y. Eo, and E. Yoon, "CMOS-compatible surface-micromachined suspended-spiral inductors for multi-GHz silicon RF ICs," Electron Device Letters, IEEE, vol. 23, pp. 591-593, 2002.
MicroChem, "Nano(Tm) SU-8 Negative Tone Phtoresist Formulations 2-25," Rev 2102 ed: MicroChem Corporation, 2002.
D. Sameoto, S. H. Tsang, I. G. Foulds, S. W. Lee, and M. Parameswaran, "Control of the out-of-plane curvature in SU-8 compliant microstructures by exposure dose and baking times," Journal of Micromechanics and Microengineering, vol. 17, pp. 1093-1098, 2007 (published Apr. 24, 2007).

M. P. Larsson, R. R. A. Syms, and A. G. Wojcik, "Improved adhesion in hybrid Si-polymer MEMS via micromechanical interlocking," Journal of Micromechanics and Microengineering, vol. 15, pp. 2074-2082, 2005.
M. Hoperoft, T. Kramer, G. Kim, K. Takashima, Y. Higo, D. Moore, and J. Brugger, "Micromechanical testing of SU-8 cantilevers," Proc. JSME Adv. Technol. Exp. Mech, pp. 735-742, 2005.
H. Lorenz, M. Laudon, and P. Renaud, "Mechanical characterization of a new high-aspect-ratio near UV-photoresist," Microelectron. Eng., vol. 41-42, pp. 371-374, 1998.
R. Feng and R. J. Farris, "The characterization of thermal and elastic constants for an epoxy photoresist SU8 coating," Journal of Materials Science, vol. 37, pp. 4793-4799, 2002.
D. Sameoto, S.-H. Tsang, and M. Parameswaran, "Polymer MEMS processing for multi-user applications," Sensors and Actuators A: Physical, vol. 134, pp. 457-464, 2007 (published online Jun. 30, 2006).
R. C. Daniels and R. W. Heath, Jr., "60 GHz Wireless Communications: Emerging Requirements and Design Recommendations," IEEE Vehicular Technology Magazine, pp. 41-50, Sep. 2007.
R. Feng and R. J. Farris, "Influence of processing conditions on the thermal and mechanical properties of SU8 negative photoresist coatings," Journal of Micromechanics and Microengineering, vol. 13, pp. 80-88, 2003.
Y. C. Tsui and T. W. Clyne, "An analytical model for predicting residual stresses in progressively deposited coatings Part 1: Planar geometry," Thin Solid Films, vol. 306, pp. 23-33, 1997.
J. R. Reid, V. M. Bright, and J. T. Butler, "Automated assembly of flip-up micromirrors," Sensors & Actuators: A. Physical, vol. 66, pp. 292-298, 1998.
N. C. Tien, O. Solgaard, M. H. Kiang, M. Daneman, K. Y. Lau, and R. S. Muller, "Surface-micromachined mirrors for laser-beam positioning," Sensors & Actuators: A. Physical, vol. 52, pp. 76-80, 1996.
K. Tsui, A. A. Geisberger, M. Ellis, and G. D. Skidmore, "Micromachined end-effector and techniques for directed MEMS assembly," Journal of Micromechanics and Microengineering, vol. 14, pp. 542-549, 2004.
V. Kaajakari and A. Lal, "Thermokinetic actuation for batch assembly of microscale hinged structures," Microelectromechanical Systems, Journal of, vol. 12, pp. 425-432, 2003.
K. W. C. Lai, A. P. Hui, and W. J. Li, "Non-contact batch microassembly by centrifugal force," Micro Electro Mechanical Systems, 2002. The Fifteenth IEEE International Conference on, pp. 184-187, 2002.
K. S. J. Pister, M. W. Judy, S. R. Burgett, and R. S. Fearing, "Microfabricated hinges," Sensors and Actuators, A: Physical, vol. 33, pp. 249-256, 1992.
R. W. Johnstone, A. H. Ma, D. Sameoto, M. Parameswaran, and A. M. Leung, "Buckled cantilevers for out-of-plane platforms," Journal of Micromechanics and Microengineering, vol. 18, p. 045024 (pp. 107), 2008 (published Mar. 14, 2008).
J. M. Z. Ocampo, P. O. Vaccaro, T. Fleischmann, T.-S. Wang, K. Kubota, T. Aida, T. Ohnishi, A. Sugimura, R. Izumoto, M. Hosoda, and S. Nashima, "Optical actuation of micromirrors fabricated by the micro-origami technique," Applied Physics Letters, vol. 83, No. 18, pp. 3647-3649, 2003.
J. Ok, C. Milton, and K. Chang-Jin, "Pneumatically driven microcage for micro-objects in biological liquid," in Micro Electro Mechanical Systems, 1999. MEMS '99. Twelfth IEEE International Conference on, 1999, pp. 459-463.
H. Lorenz, M. Despont, N. Fahrni, N. LaBianca, P. Renaud, and P. Vettiger, "SU-8: a low-cost negative resist for MEMS," J. Micromech. Microeng, vol. 7, pp. 121-124, 1997.
B. Razavi, "A 60-GHz CMOS receiver front-end," IEEE Journal of Solid-State Circuits, vol. 41, No. 1, pp. 17-22, Jan. 2006.
S. Reynolds , B. Floyd, U. Pfeiffer, T. Beukema , J. Grzyb and C. Haymes, "A silicon 60 GHz receiver and transmitter chipset for broadband communications," IEEE J. Solid-State Circuits, vol. 41, pp. 2820, Dec. 2006.
B. Heydari, M. Bohsali, E. Adabi, A. M. Niknejad, "Millimeter-Wave Devices and Circuit Blocks up to 104 GHz in 90 nm CMOS," IEEE Journal of Solid-State Circuits, vol. 42, No. 12, pp. 2893-2903, Dec. 2007.
A. Shamim, L. Roy, N. Fong, N. G. Tarr, "24 GHz On-Chip Antennas and Balun on Bulk Si for Air Transmission," IEEE Transactions on Antennas and Propagation, vol. 56, No. 2, pp. 303-311, Feb. 2008.
E. Ojefors, K. Grenier, L. Mazenq, F. Bouchriha, A. Rydberg, R. Plana, "Micromachined inverted F antenna for integration on low resistivity silicon substrates," IEEE Microwave and Wireless Components Letters, vol. 15, No. 10, pp. 627-629, Oct. 2005.
A. Babakhani, X. Guan, A. Komijani, A. Natarajan, A. Hajimiri, "A 77-GHz Phased-Array Transceiver With On-Chip Antennas in Silicon: Receiver and Antennas," IEEE Journal of Solid-State Circuits, vol. 41, No. 12, pp. 2795-2806, Dec. 2006.
K. K. O et al, "On chip antennas in Silicon ICs and their application," IEEE Tras. on Electron Devices, IEEE Transactions on Electron Devices, vol. 52, No. 7, pp. 1312-1323, Jul. 2005.
J. Kim and D. Peroulis, "On-chip Monopole Antennas using Predeformed Cantilevers," Proceedings of 2007 IEEE Antennas and Propagation Symposium, pp. 2309-2312, Jun. 2007.
J, -C. Langer, J. Zou, C. Liu, J. T. Bernhard, "Micromachined reconfigurable out-of-plane microstrip patch antenna using plastic deformation magnetic actuation," Microwave and Wireless Components Letters, vol. 13, No. 3, pp. 120-122, Mar. 2003.
B. A. Floyd, Chih-Ming, Huang, Kenneth K.O., "Intra-chip wireless interconnect for clock distribution implemented with integrated antennas, receivers, and transmitters," IEEE Journal of Solid-State Circuits, vol. 37, No. 5, pp. 543-552, May 2002.
Y. P. Zhang, M Sun, L. H. Guo, "On-chip antennas for 60-GHz radios in silicon technology," IEEE Transactions on Electron Devices, vol. 52, No. 7, pp. 1664-1668, Jul. 2005.
M. Pons, F. Touati, and P. Senn, "Study of on-chip integrated antennas using standard silicon technology for short distance communications," 2005 European Microwave Conference, Oct. 2005.
E. Ojefors, H. Kratz, K. Grenier, R. Plana, A. Rydberg, "Micromachined Loop Antennas on Low Resistivity Silicon Substrates," IEEE Transactions on Antennas and Propagation, vol. 54, No. 12, pp. 3593 3601, Dec. 2006.
J. G. Kim, H. S. Lee, J. B. Yoon, and S. Hong, "60-GHz CPW-fed post-supported patch antenna using micromachining technology," IEEE Microwave and Wireless Components Letters, vol. 15, pp. 635-637, 2005.
G. P. Gauthier, J. P. Raskin, L. P. B. Katehi, and G. M. Rebeiz, "A 94-GHz aperture-coupled micromachined microstrip antenna," IEEE Trans. Antennas Propag., vol. 47, No. 12, pp. 1761-1766, Dec. 1999.
B. Pan, Y. -K. Yoon, G. E. Ponchak, M. G. Allen, J. Papapolymerou, M. M. Tentzeris, "Analysis and Characterization of a High-Performance Ka-Band Surface Micromachined Elevated Patch Antenna," Antennas and Wireless Propagation Letters, vol. 5., No. 1., pp. 511-514, Dec. 2006.
K. Sarabandi and D. H. Liao, "Near-Earth Performance Analysis and Optimization of Low-Profile Antennas," Radio and Wireless Symposium, 2007 IEEE, pp. 245-248, 2007.
B. Pan, Y Yoon, P Kirby, J Papapolymerou, MM Tenzeris, and M. Allen, "A W-band surface micromachined monopole for low-cost wireless communication systems," 2004 Microwave Symposium Digest, pp. 1935-1938, Jun. 2004.
Y. Yoon, B Pan, J Papapolymerou, MM Tentzeris, MG, "A vertical W-band surface-micromachined Yagi-Uda antenna," Antennas and Propagation Society International Symposium, pp. 594-597, 2005.
R. G. Vaughan, J. B. Andersen, M. H. Langhorn, "Circular array of outward sloping monopoles for vehicular diversity antennas," IEEE Trans. Antenna Propagat., vol. 36, No. 10, pp. 1365-1374, Oct. 1988.
J. Zou, J. Chen, Ch. Liu, and J.E. Schutt-Aine, "Plastic deformation magnetic assembly (PDMA) of out of plane microstructures: technology and application," J. MEMS, vol. 10, No. 2, pp. 302-309, 2001.
S. W. Lee, D. Sameoto, A. Mahanfar, and M. Parameswaran, "Lithographic stress control for the self-assembly of polymer MEMS structures," Journal of Micromechanics and Microengineering, vol. 18, p. 085004 (pp. 1-8), 2008 (published Jun. 26, 2008).
N. Chronis and L. P. Lee, "Polymer MEMS-based microgripper for single cell manipulation," in 2004 Proc. 17th IEEE Int. Conf. Micro Electro Mechanical Systems, pp. 17-20.
F. D. Mbairi and H. Hesselbom, "High frequency design and characterization of SU-8 based conductor backed coplanar waveguide transmission lines," in Proc. Int. Adv. Packag.: Processes, Properties, Interfaces Symp., Mar. 2005, pp. 243-248.

A. Mahanfar, and R. G. Vaughan, "Self and mutual impedances of monopoles on a circular disk," Antennas and Propagation International Symposium, 2007 IEEE , vol., No., pp. 229-232, Jun. 9-15, 2007.

W. R. Eisenstadt and Y. Eo, "S-parameter based IC interconnect transmission line characterization," IEEE Trans. on Components, Hybrids, and Manufacturing Technology, vol. 15, No. 2, pp. 483-490, Aug. 1992.

R. R. A. Syms, E. M. Yeatman, V. M. Bright, and G. M. A. W. G. M. Whitesides, "Surface tension-powered self-assembly of microstructures—the state-of-the-art," Microelectromechanical Systems, Journal of, vol. 12, pp. 387-417, 2003.

Contact: Elmer K. Sum, Technology Manager, "3D MEMS Antenna Strategic Partnering Opportunity," Simon Fraser University, p. 1, published Jun. 2008.

P.O. Vaccaro, K. Kubota, T. Aida, "Strain Driven Self-positioning of micromachined structures," Applied Physics Letters, vol. 78, No. 19, pp. 2852-2854, May 2001.

V. Y. Prinz, V. A. Seleznev, A. K. Gutakovsky, A. V. Chehovskiy, V. V. Preobrazhenskii, M. A. Putyato, and T. A. Gavrilova, "Free-standing and overgrown InGaAs/GaAs nanotubes, nanohelices and their arrays," Physica E: Low-dimensional Systems and Nanostructures, vol. 6, pp. 828-831, 2000.

V. M. Lubecke, B. Barber, E. Chan, D. Lopez, M. E. Gross, and P. Gammel, "Self-assembling MEMS variable and fixed RF inductors," Microwave Theory and Techniques, IEEE Transactions on, vol. 49, pp. 2093-2098, 2001.

P. L. Gammel, B. P. Barber, V. M. Lubecke, N. Belk, and M. R. Frei, "Design, test, and simulation of self-assembled micromachined rf inductors," Proceedings of SPIE, vol. 3680, p. 582-591, 1999.

M. Despont, H. Lorenz, N. Fahmi, J. Brugger, P. Renaud, and P. Vettiger, "High-aspect-ratio, ultrathick, negative-tone near-uv photoresistfor MEMS applications," Micro Electro Mechanical Systems, 1997. MEMS'97, Proceedings, IEEE., Tenth Annual International Workshop on, pp. 518-522, 1997.

A. E. Franke, D. Bilic, D. T. Chang, P. T. Jones, T. J. King, R. T. Howe, and G. C. Johnson, "Post-CMOS integration of germanium microstructures," Micro Electro Mechanical Systems, 1999. MEMS'99. Twelfth IEEE International Conference on, pp. 630-637, 1999.

P. W. Green, R. R. A. Syms, and E. M. Yeatman, "Demonstration of three-dimensional microstructure self-assembly," Microelectromechanical Systems, Journal of, vol. 4, pp. 170-176, 1995.

* cited by examiner

LITHOGRAPHICALLY CONTROLLED CURVATURE FOR MEMS DEVICES AND ANTENNAS

CROSS-REFERENCE TO RELATED APPLICATIONS

This application claims the benefit of the priority of U.S. application No. 60/964,814 filed 16 Aug. 2007 which is hereby incorporated herein by reference.

TECHNICAL FIELD

This invention relates to microelectromechanical systems (MEMS) devices. Particular embodiments provide apparatus and methods for controlling the curvature of MEMS devices. Particular embodiments provide MEMS antenna apparatus and methods of assembling and operating same.

BACKGROUND

Three-dimensional MEMS devices have been an area of interest for a number of years. The off-substrate (also referred to as out-of-plane) dimensions of MEMS devices have typically been relatively small, with most micromachining processes only able to fabricate low aspect ratio structures—i.e. structures with relatively small off-substrate dimensions relative to their on-substrate (in-plane) dimensions.

Newer micromachining fabrication technologies, such as deep reactive ion etching (DRIE) have produced higher aspect ratio structures in silicon. Most DRIE processes are limited to a single structural thickness and offer limiting off-substrate functionality. To overcome the shortcomings of planar surface micromachining technology, assembly mechanisms have been developed to take thin on-substrate structures and manipulate particular components to provide off-substrate structures. This form of manipulating on-substrate components to provide out-of plane structures has been performed using integrated on-chip actuators or pick-and-place external robotic systems. Micromachined hinges have also been developed to provide out-of-plane structures by permitting particular components to rotate out of the substrate plane. A number of compliant mechanisms have also been introduced to permit serial assembly of MEMS structures with a single push. Examples of prior art processes for fabricating off-substrate MEMS components include:

Reid J R, Bright V M and Butler J T 1998 Automated assembly of flip-up micromirrors *Sensors Actuators* A 66 292-8;

Tien N C, Solgaard O, Kiang M-H, Daneman M, Lau K Y and Muller R S 1996 Surface-micromachined mirrors for laser-beam positioning *Sensors Actuators* A 52 76-80;

Tsui K, Geisberger A A, Ellis M and Skidmore G D 2004 Micromachined end-effector and techniques for directed MEMS assembly *J. Micromech. Microeng.* 14 542-9;

Kaajakari V and Lal A 2003 Thermokinetic actuation for batch assembly of microscale hinged structures *J. Microelectromech. Syst.* 12 425-32;

Lai K W C, Hui A P and Li W J 2002 Non-contact batch micro-assembly by centrifugal force 15*th IEEE Int. Conf Micro Electro Mechanical Systems* pp 184-7;

Johnstone R W, Sameoto D and Parameswaran M 2006 Non-uniform residual stresses for parallel assembly of out-of-plane surface-micromachined structures *J. Micromech. Microeng.* 16 N17-22;

Pister K S J, Judy M W, Burgett S R and Fearing R S 1992 Microfabricated hinges *Sensors Actuators* A 33 249-56;

Johnstone R W, Ma A H, Sameoto D, Parameswaran M and Leung A M 2008 Buckled cantilevers for out-of-plane platforms *J. Micromech. Microeng.* 18 045024;

Tsang S H, Sameoto D, Foulds I G, Johnstone R W and Parameswaran M 2007 Automated assembly of hingeless 90° out-of-plane microstructures *J. Micromech. Microeng.* 17 1314-25.

There is a general desire to provide self-assembling MEMS structures with out-of-plane components.

Typical wireless devices and communication networks require antennas to send and receive information via electromagnetic waves. For miniaturized devices and for other applications (e.g. System-on-Chip (SoC) and System-in-Package (SiP) applications), it is desired to integrate antennas onto the same chip, into the same package or at least in close proximity to the chip on which the antenna feeding mechanism and/or other signal/data processing components are implemented.

Conventional on-chip antennas are typically of the in-plane patch-type that extend in the plane of the substrate—see, for example, M. Pons et al., "Study of on-chip integrated antennas using standard silicon technology for short distance communications," 2005 European Microwave Conference, October 2005 and E. Ojefors et al., "Micromachined Loop Antennas on Low Resistivity Silicon Substrates: IEEE Transactions on Antennas and Propagation, Vol. 54, No. 12, pp. 3593-3601, December 2006. However, in CMOS, GaAs and other technologies, the substrate on which antenna feeding mechanism and/or other signal/data processing components (e.g. analog-to-digital converted, amplifiers and the like) are implemented can be lossy (i.e. relatively conductive) and can result in reduced antenna efficiency. Such conductivity may be required in CMOS technology to prevent latch-up issues, for example. Because the substrate is lossy, in-plane patch-type antennas suffer from low efficiency. which in-turn impact the range and data-rate of the communication system.

There is a general desire to distance at least portions of antennas from the substrate to avoid unnecessary losses in antenna efficiency. There are corresponding desires to provide antenna design flexibility which allow control over antenna parameters, such as the length, elevation, azimuthal angle and profile shape of the antenna.

BRIEF DESCRIPTION OF THE DRAWINGS

In drawings which depict non-limiting embodiments of the invention.

The reader should appreciate that in the illustrative drawings presented herewith lines and/or shading may be provided to delineate features for clarity even though such delineation may not actually be present in corresponding structures.

DETAILED DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Aspects of the invention provide self-assembling three-dimensional MEMS structures and methods for fabricating and assembling same which involve application of stress between structural layers of cantilever structures. Particular embodiments permit control of the magnitude and direction of curvature by controlling the location of application of such stress and/or by using mechanical reinforcements to resist bending of the cantilever in certain direction. Particular embodiments provide self-assembling MEMS antennas wherein at least a portion of the antenna is spaced apart from the substrate.

Figure 1:
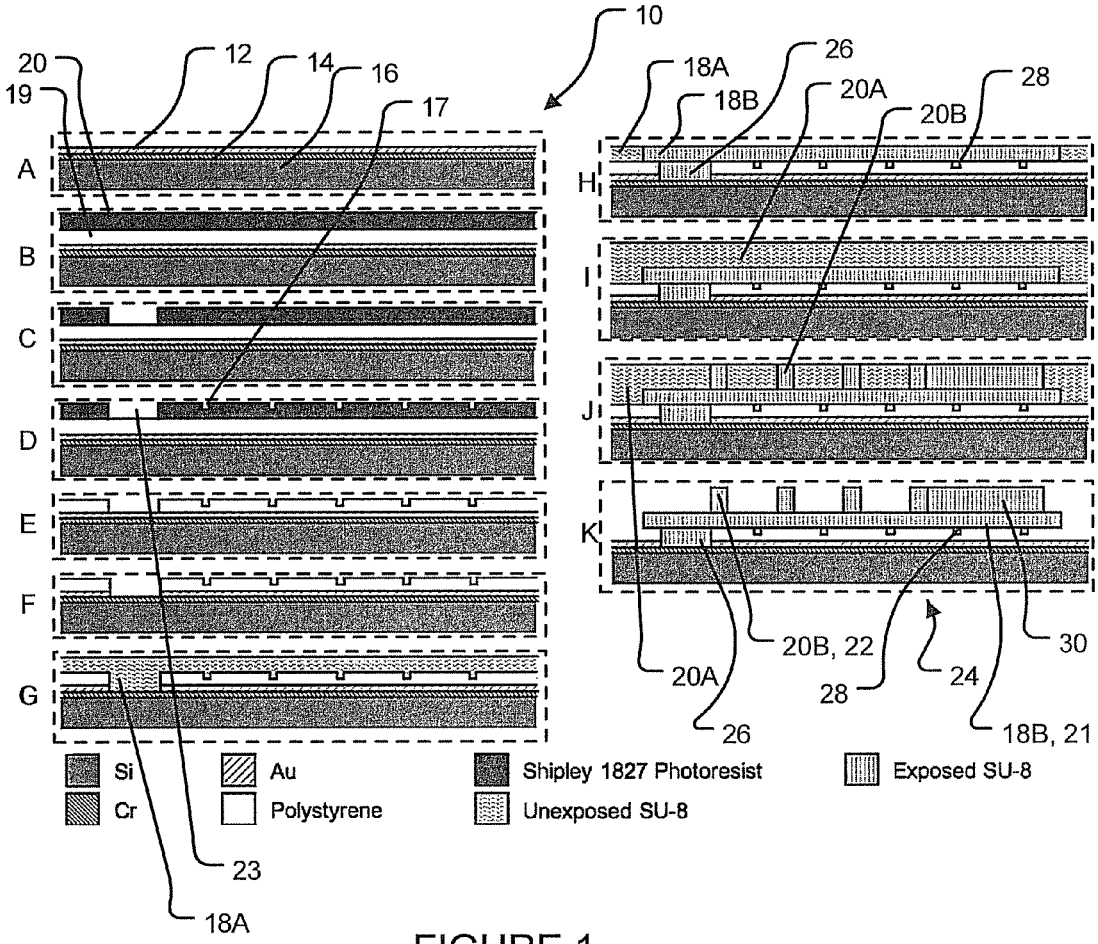
FIGS. 1A-1K (collectively, FIG. 1) show a partial cross-sectional side view of a process for fabricating a self-assembling MEMS structure according to a particular embodiment of the invention.

FIG. 1 shows a method 10 for fabricating a self-assembling MEMS structure 24 according to a particular embodiment of the invention. In FIG. 1A of the illustrated embodiment, metal layers 12, 14 are sputtered onto substrate 16. Substrate 16 may be a wafer of silicon (Si), for example. Metal layers 12, 14 may be used for patterning alignment markers. In particular embodiments, metal layer 12 may comprise gold (Au) and metal layer 14 may comprise chromium (Cr), although other materials could be used. In particular embodiments, the thickness of metal layers 12, 14 is in a range of 5-1000 nm. Metal layers 12, 14 are not required. Some embodiments may involve fabrication of structures without underlying metal layers and other embodiments may involve fabrication of structures with different numbers of underlying metal layers. In FIG. 1B, a sacrificial layer 19 and a photoresist layer 20 are applied. In particular embodiments, sacrificial layer 19 and photoresist layer 20 may be applied using a spinning process. In the illustrated embodiment, sacrificial layer 19 comprises polystyrene and photoresist 20 comprises Shipley 1827 (Rohm & Haas, Philadelphia, Pa.), although other materials could be used. In particular embodiments, the thickness of sacrificial layer 19 is in a range of 0.5-50 μm.

In FIG. 1C, the wafer is exposed through a first mask (anchor mask) and then developed to define anchor feature 23 which will eventually become anchor 26 of structure 24. In some embodiments, where sacrificial layer 19 is sensitive to the photoresist developer, then it may be desirable to do a timed exposure to leave a thin layer of photoresist 19 in the region of anchor feature 23 and then subsequently etch through the remaining photoresist using reactive ion etching (RIE). In FIG. 1D, the wafer is optionally exposed through a second mask (dimple mask) and then developed to define dimple features 17 which will eventually become optional protrusions 28 of structure 24. Protrusions 28 may reduce stiction between structure 24 and substrate 16. Dimple features 17 may have a depth on the order of 0.2-0.8 the thickness of photoresist 20. In particular embodiments, photoresist 20 may have a thickness in a range of 1-20 μm and dimple features 17 may have a depth of 0.4-16 μm.

In FIG. 1E, an etching process is used to transfer anchor feature 23 and optional dimple features 17 to sacrificial layer 19. The characteristics of the etching process will depend on the characteristics of sacrificial layer 19 and photoresist 20. The etching process is completed when metal layer 12 is revealed through anchor feature 23 In FIG. 1F, top metal layer 12 is etched from within anchor feature 23. In some embodiments, bottom metal layer 14 may have relatively high (as compared to top metal layer 12) adhesion characteristics to the material used to form first structural layer 18A (and anchor 26).

In FIG. 1G, first structural layer 18A is applied to fill anchor feature 23 and dimple features 17 and to coat sacrificial layer 19—e.g. by spinning or any other suitable method of application. In particular embodiments, the thickness of first structural layer 18A may be in a range of 0.5-50 μm. By way of non-limiting example, first structural layer 18A may comprise one or more polymers. In particular embodiments, first structural layer 18A comprises SU-8 or polyimide, although other materials containing other curable (cross-linkable) epoxies and/or polymers may be used. In some embodiments, FIG. 1G may comprise so-called "soft baking" by application of heat to bring the material in first structural layer 18A to a semi-solid (or at least more viscous) state. FIG. 1H, involves application of UV light to first structural layer 18A through a first-structural-layer mask to cause it to cure (cross-link) to provide cured first structural layer 18B in the regions that will eventually form cantilever arm 21 and anchor 26 of structure 24. FIG. 1H may involve over-exposing the first structural layer 18A to maximize cross-linking in cured first structural layer 18B. In some embodiments, FIG. 1H may also comprise a post-exposure bake via application of heat.

In FIG. 1I, a second structural layer 20A is applied atop first structural layer 18A, 18B—e.g. by spinning or any other suitable method of application. In currently preferred embodiments, second structural layer 20A uses the same material used for first structural layer 18A, but this is not necessary and it is expressly considered that desirable features could be obtained by using different materials for first and second structural layers 18A, 20A. In particular embodiments, the thickness of second structural layer 20A may be in a range of 1-100 μm. In some embodiments, the ratio of the thickness of second structural layer 20A to the thickness of first structural layer 18A may be on the order of 0.5-5. In some embodiments, FIG. 1I may also involve soft baking. FIG. 1J involves exposing second structural layer 20A to UV light through a second-structural-layer mask to cause it to cure (cross-link) to provide cured second structural layer 20B in the regions that will eventually form posts 22 and stiffener 30 of structure 24. FIG. 1J may involve over-exposing the second structural layer 20A to maximize cross-linking in cured second structural layer 20B and to ensure good adhesion between first and second cured structural layers 18B, 20B. In some embodiments, FIG. 1J may also comprise a post-exposure bake via application of heat.

FIG. 1K involves developing the unexposed portions of the material(s) used to form first and second structural layers 18A, 20A, leaving behind the cured portions of first and second structural layers 18B, 20B. FIG. 1K also involves removing sacrificial layer 19. In particular embodiments, sacrificial layer 19 is removed by dissolving it in a suitable solvent, although other removal methods may be used. Structure 24 is then ready for self-assembly.

FIG. 1 represents one particular embodiment for fabrication of structure 24. It will be appreciated that there are other suitable techniques that could be used for fabrication of structure 24. Preferably, such fabrication techniques are lithographic techniques, although this is not necessary. Preferably such techniques involve surface micromachining as opposed to bulk micromachining, although this is not necessary. By way of non-limiting example, a variation of method 10 may involve spinning on the first and/or second structural layers 18A, 20A, curing the structural layer(s) and then patterning the cured structural layer(s). Patterning cured structural layers may involve a suitable combination of application of photoresist, patterning photoresist, application of metal, conventional metal etching and reactive ion etching (RIE), for example.

Figure 2A:
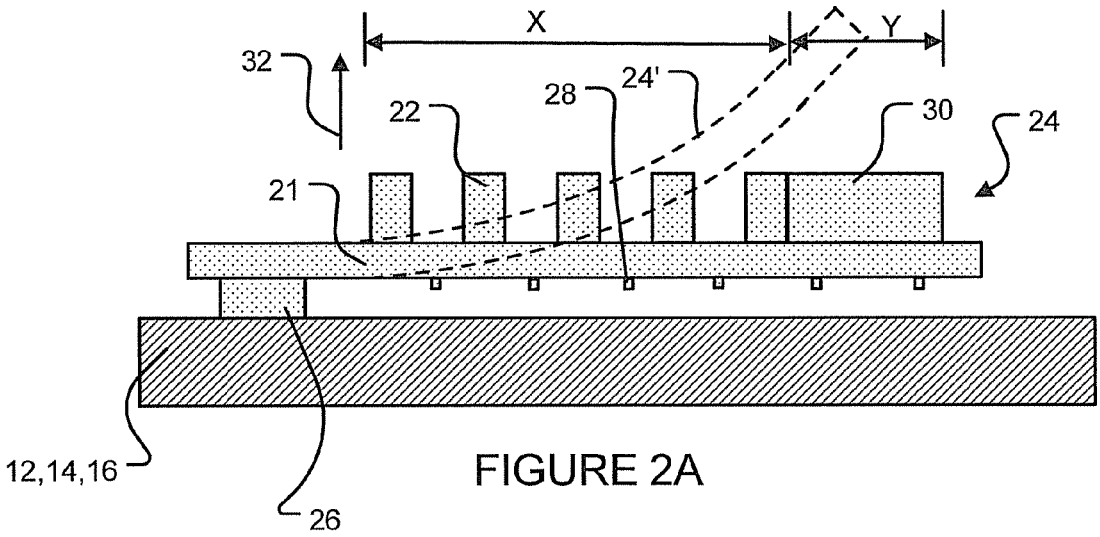
FIGS. 2A-2B (collectively, FIG. 2) respectively show a partial cross-sectional side view and a top plan view of a MEMS structure fabricated according to the method of FIG. 1.
Figure 2B:
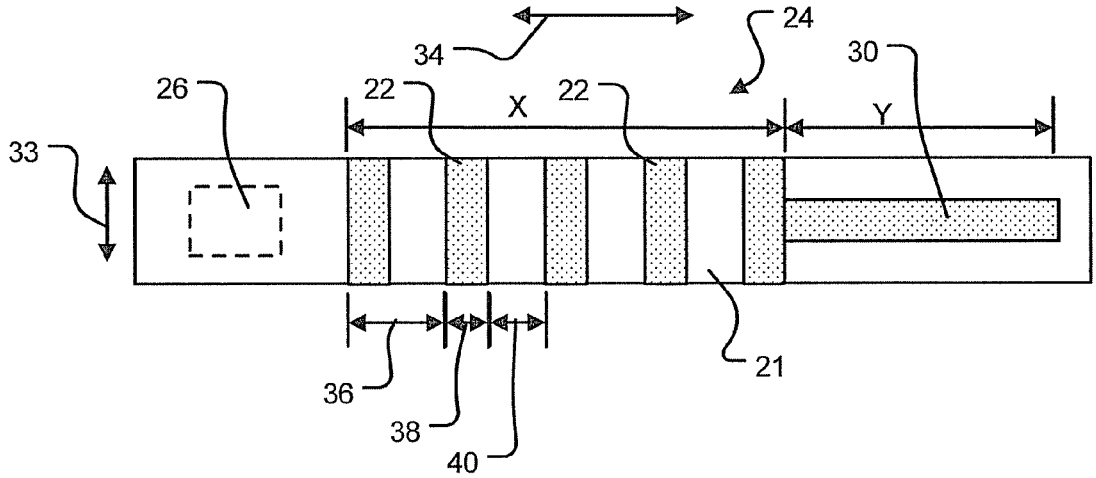

The resulting structure 24 fabricated by method 10 is shown prior to self-assembly in FIG. 2A (partial cross-sectional side view) and FIG. 2B (top view). In the drawings of FIGS. 2A and 2B, lines and/or shading may be provided to delineate features for clarity even though such delineation may not actually be present in structure 24. When the material used to form first and second structural layers 18A, 20A cures, cross-links and/or polymerizes to form first and second cured structural layers 18B, 20B, the material shrinks in volume. This shrinking volume creates stress which causes curvature of structure 24 and the resultant self-assembly. In the remainder of this description, the process of curing, cross-linking and/or polymerization is referred to as curing without loss of generality. However, it will be appreciated that volume shrinkage is not limited to curing. With other materials, other volume shrinkage processes may create stress which causes curvature of structure 24 and the resultant self-assembly.

Since first structural layer 18B is already cured (FIG. 1H) prior to application of second structural layer 20A (FIG. 1I), the curing of second structural layer 20A to form cured second structural layer 20B (FIG. 1J) causes shrinkage of the second structural layer relative to first cured structural layer 18B. However, first cured structural layer 18B and second cured structural layer 20B are mechanically connected (e.g. by chemical bonding). This relative inter-layer shrinkage (i.e. between first and second structural layers) together with the mechanical connection therebetween causes a resulting inter-layer stress between cured first structural layer 18B and cured second structural layer 20B, which in turn causes self-assembly of structure 24 in an out-of-plane direction 32 (FIG. 2A) as described in more detail below.

This inter-layer shrinkage may cause isotropic or anisotropic stress in the in-plane directions between cantilever arm 21 and posts 22 at the interfaces between cantilever arm 21 and posts 22. For example, such stress may comprise components which act in longitudinal direction 34 and in transverse direction 33 (see double-headed arrows of FIG. 2B). In this description, the longitudinal direction may be considered to be the direction of extension of a cantilever arm toward and/or away from its anchor prior to self-assembly. In the illustrated embodiment of FIG. 2B, longitudinal direction 34 is the direction that cantilever arm 21 extends toward and/or away from its anchor 26. In this description, transverse direction 33 may be the in-plane direction(s) that is/are orthogonal to longitudinal direction 34.

Such interlayer stress acting on cantilever arm 21 can cause cantilever arm 21 to bend. However, posts 22 also provide some rigidity to cantilever arm 21, as structure 24 is thicker (in out-of-plane direction 32) in the regions of posts 22. The rigidity provided by posts 22 to structure 24 is influenced by the geometry of posts 22. For example, as shown in FIG. 2B, posts 22 have transverse dimensions (in transverse direction 33) that are greater than their longitudinal directions (in longitudinal direction 34). Consequently, posts 22 may provide relatively high rigidity to cantilever arm 21 bending in transverse direction 33 and relatively low rigidity to cantilever arm 21 bending in longitudinal direction 34.

Posts 22 are also spaced apart from one another in longitudinal direction 34. Such longitudinal spacing between posts 22 can further reduce the rigidity of posts 22 to cantilever arm 21 bending in longitudinal direction 34.

This inter-layer stress created by posts 22 on cantilever arm 21 has been shown by the inventors to cause self-assembly of structure 24 in out-of-plane direction 32 by causing curvature of cantilever arm 21. This curvature is shown schematically in dotted outline 24' of FIG. 2A. The inventors have demonstrated that cantilevered structures exhibit relatively high curvature in regions where second cured structural layer 20B comprises longitudinally spaced-apart posts 22 (as shown in region X of FIGS. 2A, 2B) when compared to regions having no second structural layer 20B and when compared to regions where second cured structural layer 20B comprises an optional longitudinally continuous stiffener 30 (as shown in region Y of FIGS. 2A, 2B). Without wishing to be bound by theory, it is currently believed that this behavior is attributable at least in part to: increased stress in region X having longitudinally spaced apart posts 22 when compared to regions having no second cured structural layer 20B; and lower stiffness in region X having longitudinally spaced-apart posts 22 when compared to the stiffness in region Y having optional longitudinally continuous stiffener 30. Protrusions 28 on the underside of cantilever arm 21 may help to prevent stiction between cantilever arm 21 and any underlying features (e.g. metal layers 12, 14 or substrate 16) by reducing the contact surface area therebetween.

In the illustrated embodiment, posts 22 have a transverse width (FIG. 2B) that is substantially similar to that of cantilever arm 21. See arrow 33 of FIG. 2B which shows the transverse direction. While this geometry can reduce stress-induced curvature of cantilever arm 21 in transverse direction 33, this geometry is not necessary. In other embodiments, posts 22 may have a transverse width that is less than that of cantilever arm 21. In the illustrated embodiment, stiffener 30 has a transverse width (FIG. 2B) that is only a fraction of the width of cantilever arm 21. This is not necessary. In other embodiments, stiffener 30 may have a transverse width that is the same as or greater than that of cantilever arm 21.

As shown in region X of FIG. 2B, one may define a number of parameters for ease of explanation. The longitudinal distance 36 between the start of successive posts 22 may be referred to as the pitch 36 of posts 22, the longitudinal dimension 38 of a post 22 may be referred to as its post length 38 and the longitudinal distance 40 between the end of a first post 22 and the beginning of an adjacent post 22 may be referred to as the gap dimension 40.

The curvature of region X of structure 24 has been found to generally increase (i.e. reduced radius of curvature) with increasing ratio of post length 38 to pitch 36. This observation may be the result of more stress being introduced by having a large post length 38 in each pitch 36. For a constant ratio of post length 38 to gap dimension 40 (i.e. a constant duty cycle), the curvature of region X of structure 24 has been found to generally increase with decreasing pitch 36. Characteristics of the curvature of region X may also be controlled by appropriate selection of the thickness (i.e. in out-of-plane direction 32) of cantilever arm 21 and posts 22. A relatively thin cantilever arm 21 could be used to create relatively high curvature.

Figure 3A:
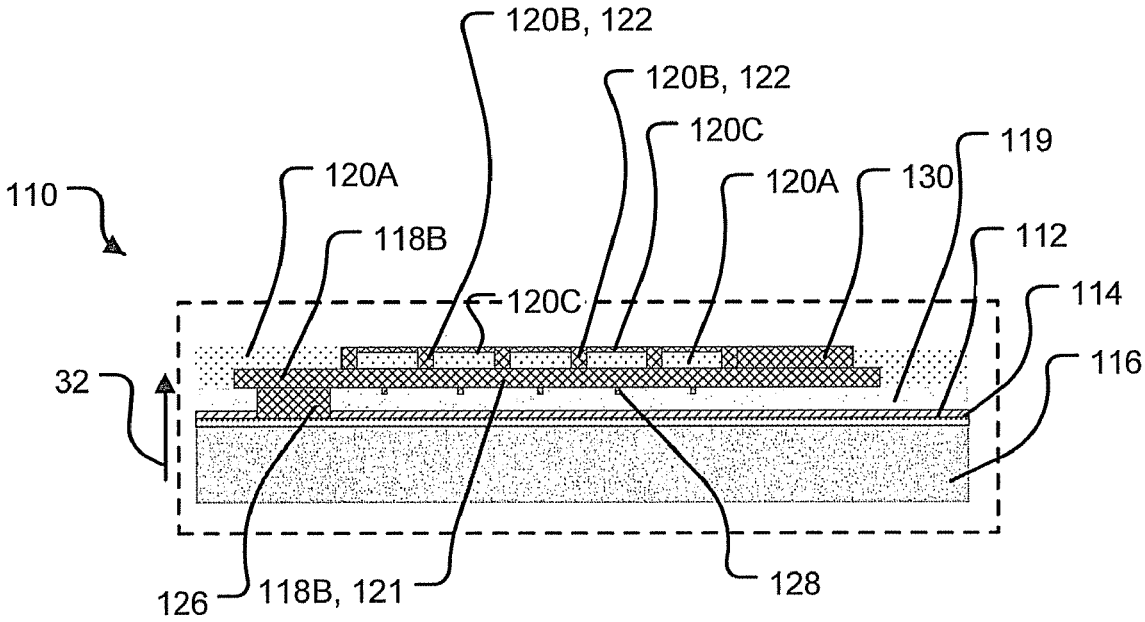
FIGS. 3A and 3B (collectively, FIG. 3) show a partial cross-sectional side view of a portion of a process for fabricating a self-assembling MEMS structure according to a particular embodiment of the invention.
Figure 3B:
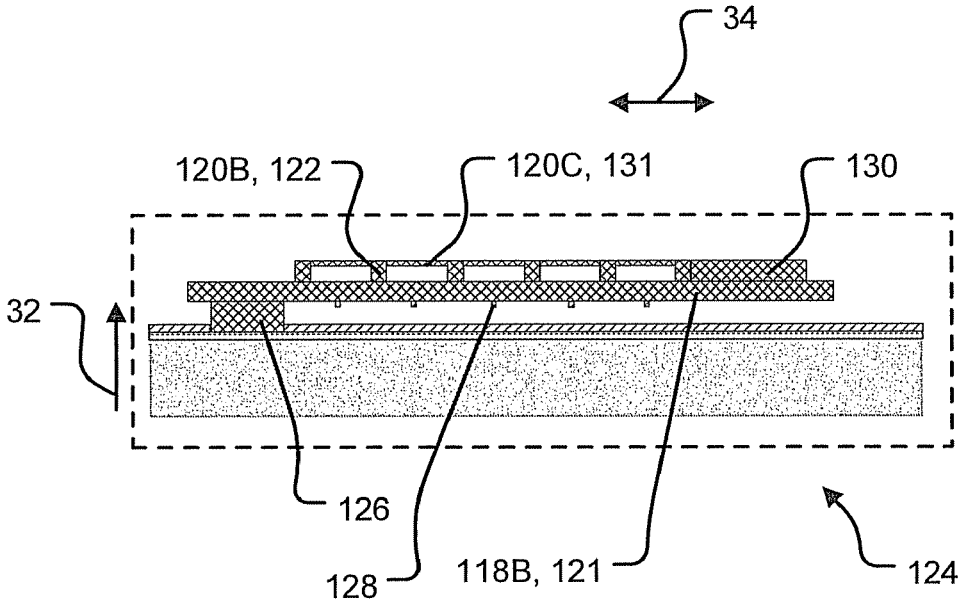

FIGS. 3A and 3B show a partial cross-sectional side view of a portion of a method 110 for fabricating a self-assembling MEMS structure 124 according to a particular embodiment of the invention. Method 110 and structure 124 are similar in many respects to method 10 and structure 24. Features of method 110 and structure 124 that are similar to those of method 10 and structure 24 are provided with similar reference numbers, except that the reference numbers referring to features of method 110 and structure 124 are preceded by the numeral 1.

Method 110 proceeds in a manner that is substantially similar to that of method 10 as shown in FIGS. 1A through 1J. Referring back to FIG. 1J, at the conclusion of steps of FIG. 1J, second structural layer 20A has been exposed to UV light through a second-structural-layer mask to cause it to cure and to provide cured second structural layer 20B in the regions that will subsequently form posts 22 and optional stiffener 30 of structure 24. Using the reference numerals of method 110 (FIG. 3), second structural layer 120A has been exposed to UV light through a second-structural-layer mask to cause it to cure and to provide cured second structural layer 120B in the regions that will subsequently form posts 122 and optional stiffener 130 of structure 124. The exposure used to cure posts 122 and stiffener 130 may involve over-exposure.

In FIG. 3A, second structural layer 120A is further exposed via a third, relatively small dose exposure (e.g. less exposure intensity and/or less exposure duration than the second exposure) through a third structural layer mask to provide cured second structural layer 120C. Cured second structural layer 120C will subsequently form stress-enhancing spans 131 which extend between posts 122 in longitudinal direction 34 and in transverse direction 33. Since the third exposure that creates cured second structural layer 120C is relatively small, the depth (in out-of-plane direction 32) of curing in second structural layer 120C is less than the corresponding depth of curing in second structural layer 120B—i.e. regions of second structural layer 120A between posts 122 are only cured to become cured second structural layer 120C in their upper portions (distal from first structural layer 118B) and remain uncured in their lower portions (adjacent first structural layer 118B). In some embodiments, FIG. 3A may also comprise a post-exposure bake via application of heat.

FIG. 3B, involves developing the unexposed portions of the material(s) used to form first and second structural layers 118A, 120A, leaving behind the cured portions of first and second structural layers 118B, 120B and 120C. FIG. 3B also involves removing sacrificial layer 119. In particular embodiments, sacrificial layer 119 is removed by dissolving it in a suitable solvent, although other removal methods may be used. Structure 124 is then ready for self-assembly.

Figure 4A:
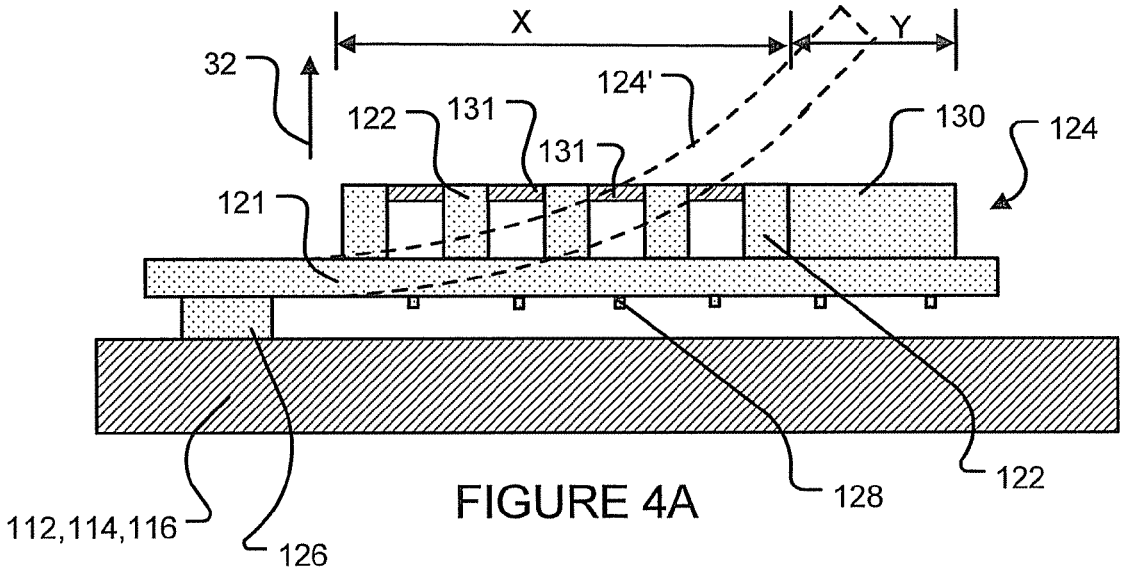
FIGS. 4A, 4B and 4C (collectively, FIG. 4) respectively show a partial cross-sectional side view, a top plan view and a photograph of a MEMS structure fabricated according to the method of FIG. 3.
Figure 4B:
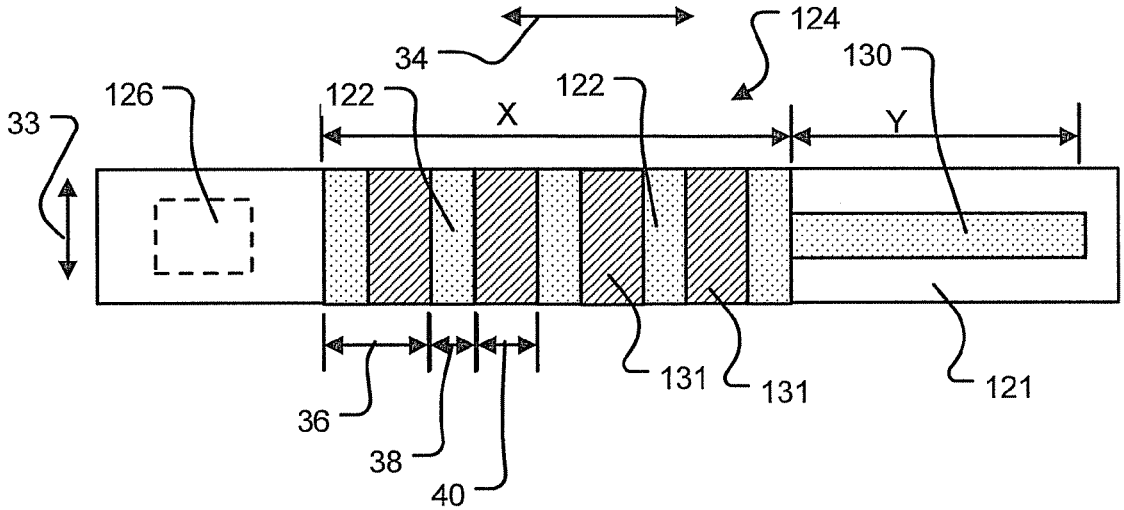
Figure 4C:
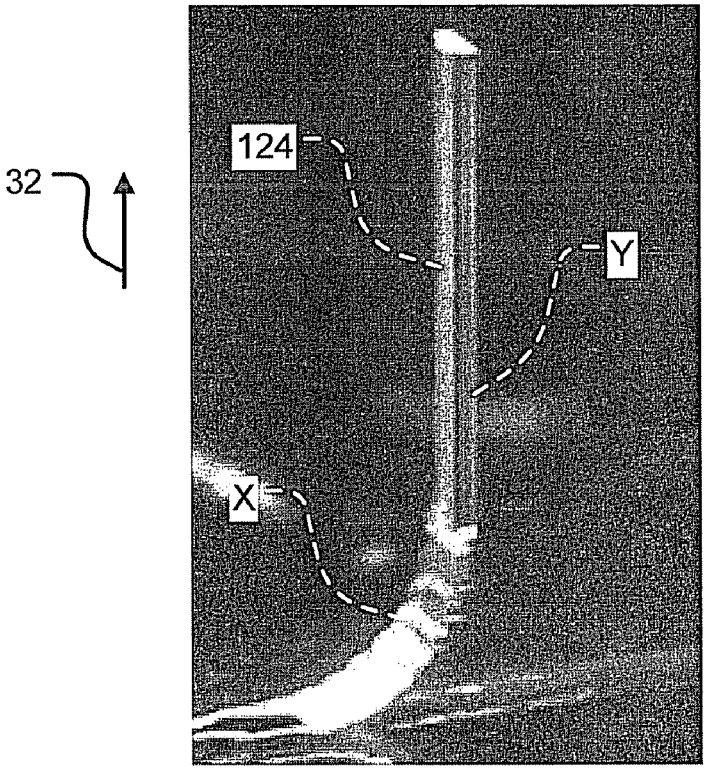

The resulting structure 124 fabricated by method 110 is shown prior to self-assembly in FIG. 4A (partial cross-sectional side view) and FIG. 4B (top view) and is shown after self-assembly in the photograph of FIG. 4C. In the drawings of FIGS. 4A and 4B, lines and/or shading may be provided to delineate features for clarity even though such delineation may not actually be present in structure 124. For example, FIG. 4A shows different shading for posts 122 and spans 131. Other than for the different fabrication processes, the principal difference between structure 124 (FIGS. 4A, 4B, 4C) and structure 24 (FIGS. 2A, 2B) is that structure 124 comprises stress-inducing spans 131 which, in the illustrated embodiment, extend longitudinally and transversely between posts 122 and which are spaced apart from cantilever arm 121 in out of plane direction 32. Stress-inducing spans 131 also shrink when they are cured, but since cantilever arm 121 is already cured prior to curing of spans 131, the curing of spans 131 and the consequent shrinkage causes increased stress on cantilever arm 121. Furthermore, spans 131 are spaced apart from cantilever arm 121 in out-of-plane direction 32, such that the contribution of spans 131 to the rigidity of cantilever arm 121 is significantly less than that of posts 122 which are in direct contract with cantilever arm 121.

In contrast to structure 24, for structure 124 having spans 131, the inventors have found that the curvature of region X generally increases with decreasing ratio of post length 38 to pitch 36. This observation may be the result of more stress being introduced by having spans 131 at locations spaced apart from cantilever arm 121 and less rigidity where post length 38 within each pitch 36 is minimized. Characteristics of the curvature of region X may also be controlled by appropriate selection of the thickness (i.e. in out-of-plane direction 32) of cantilever arm 21 and posts 22. A relatively thin cantilever arm 21 could be used to create relatively high curvature.

FIG. 4C shows a picture of a self-assembling MEMS structure 124 fabricated in accordance with method 110 of FIG. 3. Structure 124 of FIG. 4C can be seen to incorporate a region X incorporating longitudinally spaced-apart posts 122 and spans 131 which cause corresponding curvature of structure 124 in this region and a region Y incorporating an optional stiffener 130. For a given radius of curvature R, a structure 124 can be assembled to curve in region X such that region Y extends directly in out-of-plane direction 32 by providing region X of cantilever arm 121 with a longitudinal dimension of $\pi R/2$.

Figure 5A:
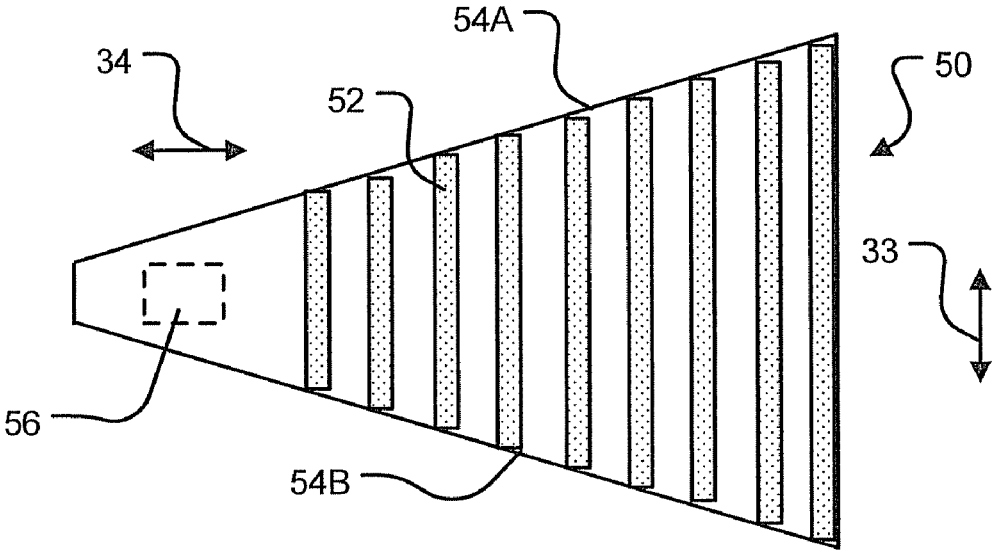
FIGS. 5A and 5B respectively show a top plan view and a photograph of another self-assembling structure having angled semi-triangular edges fabricated according to the method of FIG. 1.
Figure 5B:
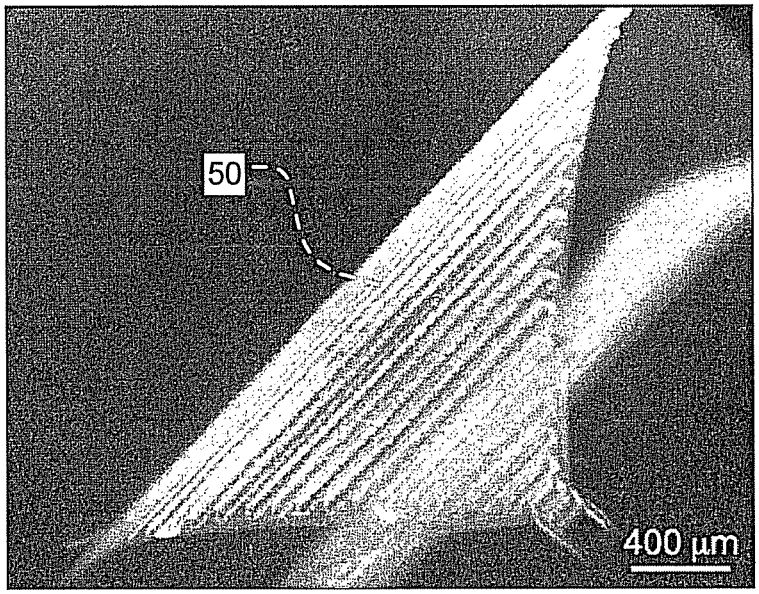

The shape of structures fabricated according to methods 10 and 110 are not limited to rectangular cantilevers. FIGS. 5A and 5B respectively depict a top view and a photograph of a partially triangular shaped self-assembling structure 50 (i.e. having transverse edges 54A, 54B which extend away from one another as they extend in longitudinal direction 34). In the illustrated embodiment, structure 50 has been fabricated in a method similar to method 10 (FIG. 1), but could also have been fabricated according to method 110 (FIG. 3) to provide stress-inducing spans. Structure 50 comprises longitudinally spaced apart posts 52 which, in the illustrated embodiment, extend across its transverse dimension 33 and are located on all or part of part of its longitudinal dimension 34. The shape of structure 50 can be particularly useful for antenna applications as explained in more detail below.

Figure 5C:
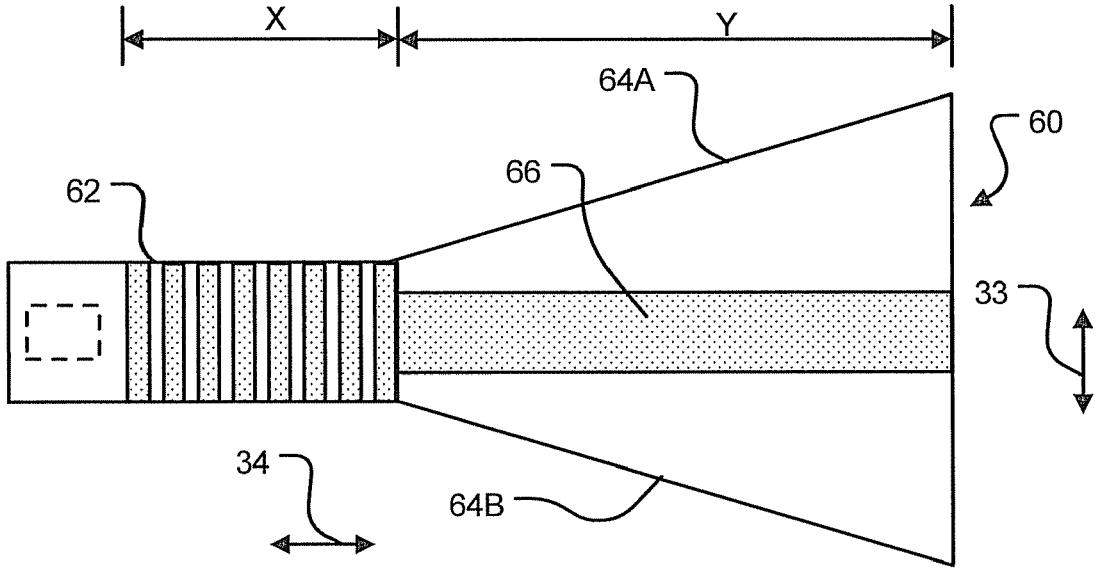
FIG. 5C is a top plan view of another self-assembling structure having angled semi-triangular fabricated according to the method of FIG. 1.

FIG. 5C illustrates a top view of a structure 60 comprising a region X having posts 62 and a partially triangular shaped region Y (i.e. having transverse edges 64A, 64B which extend away from one another as they extend in longitudinal direction 34). In the illustrated embodiment, structure 60 is fabricated by a method similar to method 10 (FIG. 1), but could also have been fabricated according to method 100 (FIG. 3) to provide stress-inducing spans. Partially triangular shaped region Y comprises an optional longitudinally continuous stiffener 66. By appropriate selection of the longitudinal length of region X, the pitch and the post length of posts 62, substantially an entirety of partially triangular shaped region Y can extend substantially in out-of-plane direction 32 (i.e. out of the page in the illustration of FIG. 5C).

Figure 6A:
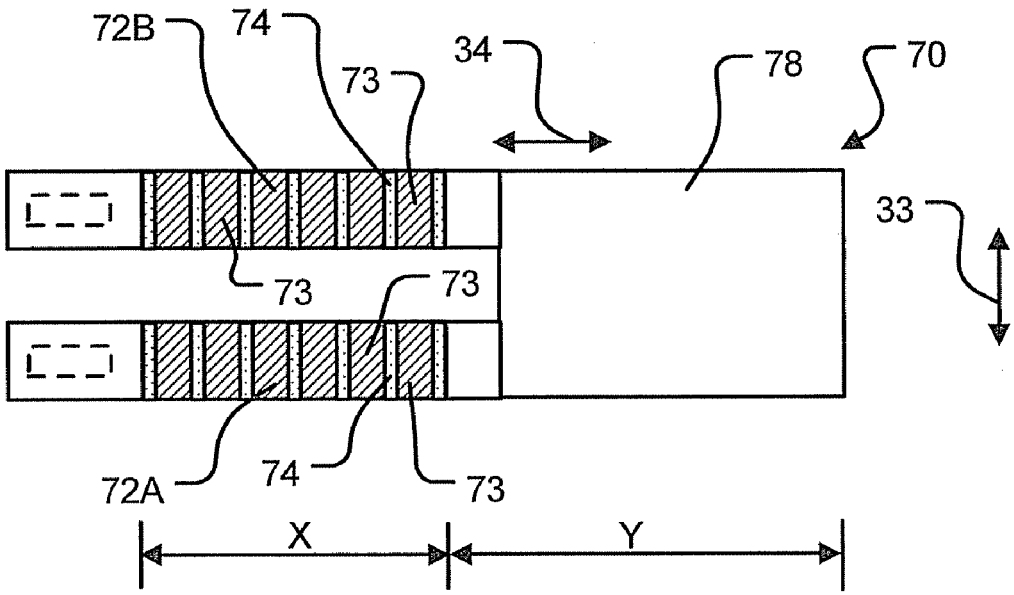
FIGS. 6A and 6B respectively show a top plan view and a photograph of another self-assembling structure incorporating a pair of curving portions fabricated according to the method of FIG. 3.
Figure 6B:
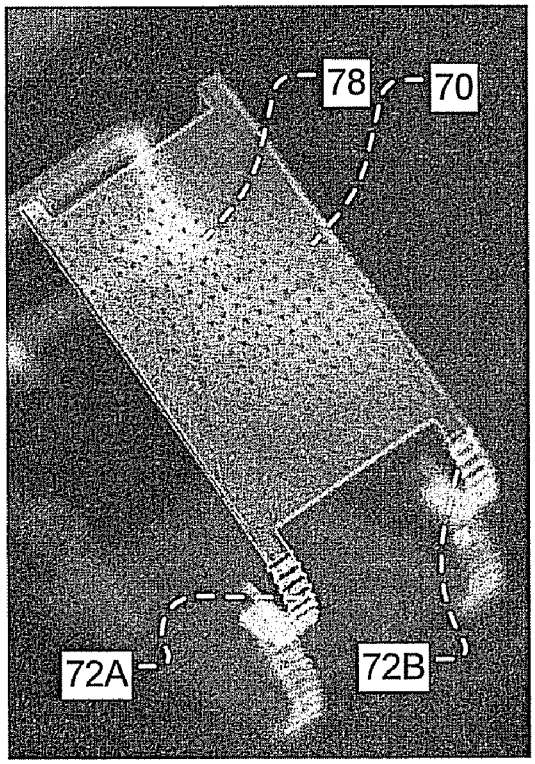

FIGS. 6A and 6B respectively show a top view and a photograph of a self-assembling structure 70 comprising a pair of self-assembling portions 72A, 72B. In the illustrated embodiment, self-assembling portions 72A, 72B are each similar to structure 124 (FIG. 4) and each comprise longitudinally spaced-apart posts 74 and stress-inducing spans 73 therebetween. Together, self-assembling portions 72A, 72B provide curving region X. In the illustrated embodiment, region Y incorporates a generally rectangular shaped component 78. In other embodiments, component 78 may have any desired shape. In other embodiments, a longitudinally continuous stiffener may be provided on component 78. The resulting self-assembled structure 70 is shown in the photograph of FIG. 6B. It will be noted that a selection of the longitudinal length of region X, the pitch of posts 74, post length of posts 74 and gap dimension between posts 74 was made such that curvature of region X (once assembled) subtends an angle of greater than 90° from the plane of the substrate. While the embodiment illustrated in FIGS. 6A and 6B comprises a pair of self-assembling portions 72A, 72B, it will be appreciated that there is no limitation on the number of self-assembling portions that could be used to support a structure and to cause it to self-assemble. Component 78 of structure 70 may be used to support sensors, actuators or other structures which may be fabricated thereon or otherwise mounted or attached thereto. Component 78 may also be used to provide an antenna.

Figure 7A:
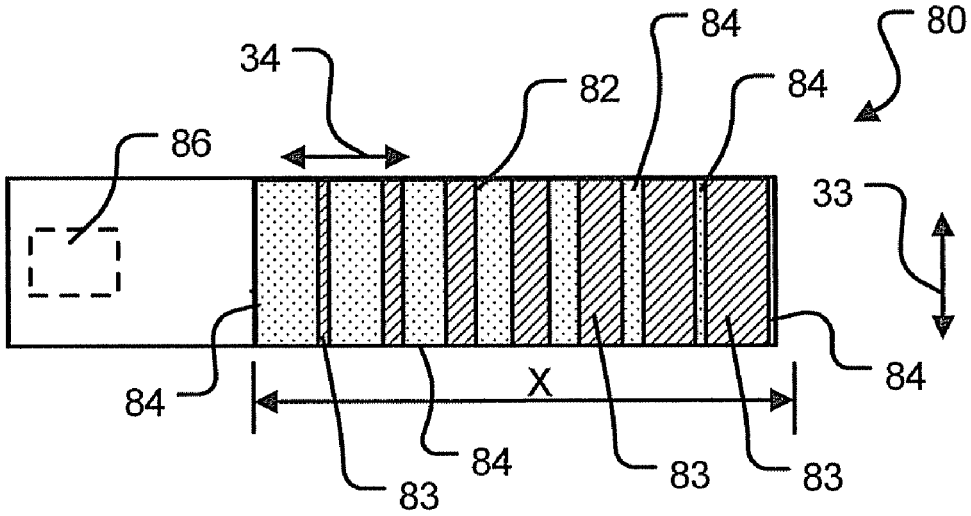
FIGS. 7A and 7B respectively show a top plan view and a photograph of another self-assembling structure incorporating a varying radius of curvature fabricated according to the method of FIG. 3.
Figure 7B:
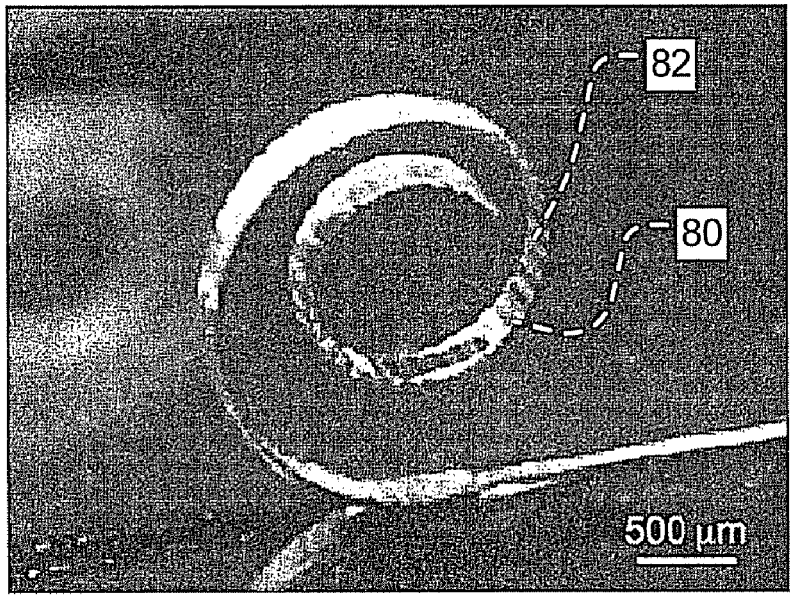

FIGS. 7A and 7B respectively show a top view and a photograph of a self-assembling structure 80 comprising a self-assembling portion 82 (region X) having posts 84 which vary in pitch, so as to cause a corresponding variation in curvature. In the illustrated embodiment, self-assembling structure 80 is fabricated to comprise posts 84 and stress-inducing spans 83 therebetween, although structure 80 could be fabricated to assemble itself without stress-inducing spans 83. In the illustrated embodiment, the pitch of posts 84 increases as self-assembling portion 82 extends further away from anchor 86 which causes correspondingly greater curvature (i.e. smaller radius of curvature) as self-assembling portion extends further away from anchor 86. The resulting self-assembled structure 80 is shown in the photograph of FIG. 7B. It will be appreciated from the discussion presented above, that the effect of varying the radius of curvature of structure 80 could be accomplished by varying parameters other than the pitch of posts 84, such as the post length of posts 84 and/or the gap dimension between posts 84.

Figure 8A:
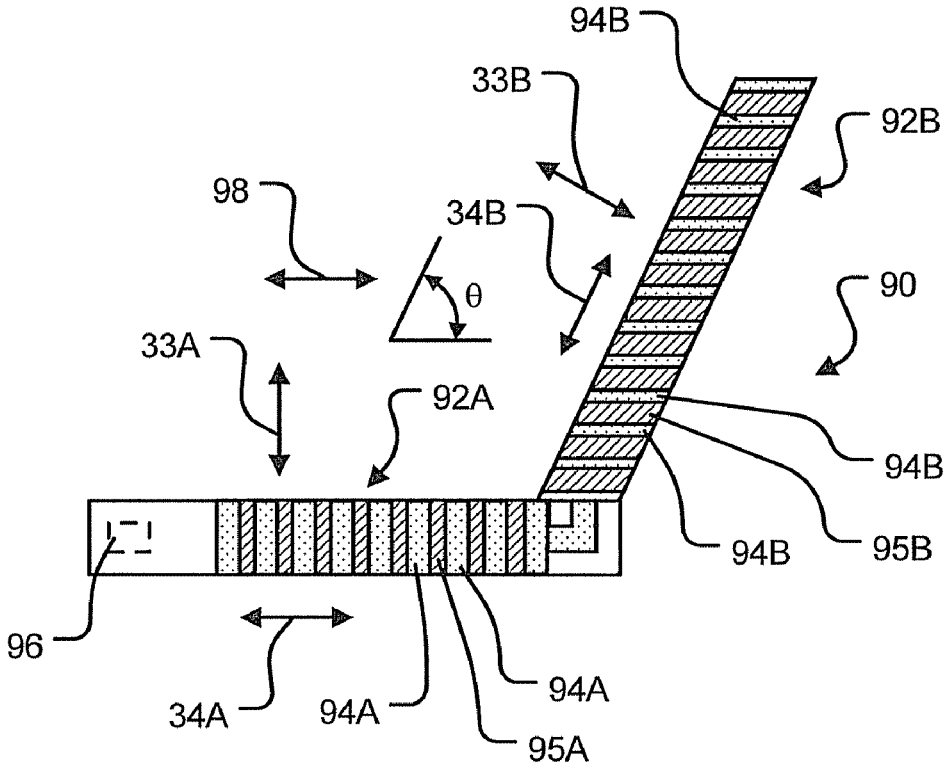
FIGS. 8A and 8B respectively show a top plan view and a photograph of a helical self-assembling structure fabricated according to the method of FIG. 3.
Figure 8B:
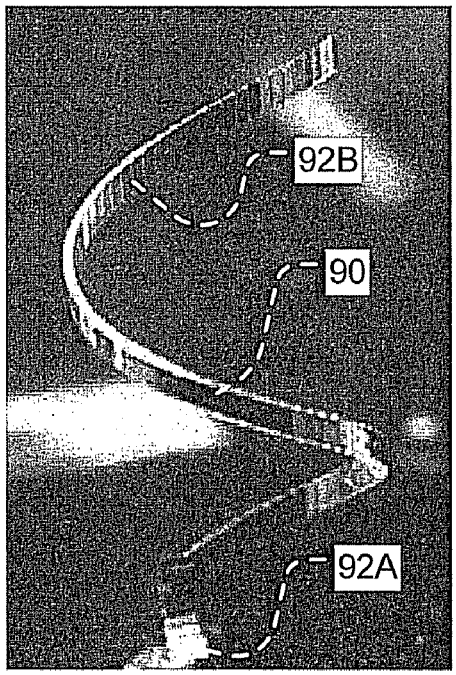

FIGS. 8A and 8B respectively show a top view and a photograph of a self-assembling helical structure 90, which is formed by providing a cantilever portion comprising posts which extend at non-orthogonal angles to the longitudinal direction of the cantilever portion. In the illustrated embodiment, structure 90 comprises a cantilever structure comprising a pair of portions 92A, 92B. First cantilever portion 92A extends in first longitudinal direction 34A away from anchor 96. First cantilever portion 92A comprises longitudinally spaced-apart posts 94A which extend in first longitudinal direction 34A and in first transverse direction 33A and stress-inducing spans 95A which extend between posts 94A. In other embodiments, spans 95A are not required. First cantilever portion 92A operates in much the same way as the above-described structures to self-assemble by curving in out-of-plane direction 32 (i.e. out of the page in FIG. 8A). In particular embodiments, first cantilever 92A may be designed with appropriate selection of length (in first longitudinal direction 34A), pitch of posts 94A, post length of posts 94A and gap dimension between posts 94A to provide an angle of curvature subtending approximately 90° (e.g 90°±15°).

Second cantilever portion 92B of structure 90 extends in a second longitudinal direction 34B away from first cantilever portion 92A. Second cantilever portion 92B comprises longitudinally spaced-apart posts 94B which extend in an non-orthogonal direction 98 with respect second longitudinal direction 34B to provide an oblique angle θ therebetween. In the illustrated embodiment, second cantilever portion 92B also comprises stress-inducing spans 95B which extend between posts 94B, although spans 95B are not necessary. In the illustrated embodiment, non-orthogonal direction 98 is parallel to first longitudinal direction 34A, but this is not necessary. Since posts 94B form an oblique angle θ with second longitudinal direction 34B, the stress induced by posts 94B in second cantilever portion 92B causes a change in direction of the curvature of second cantilever portion 92B upon self-assembly. The resulting self-assembled helical structure 90 is shown in the photograph of FIG. 8B.

It will be appreciated that the helical radius of structure 90 can be controlled by appropriate variation of the pitch, post length and or gap dimension of posts 94B in second cantilever portion 92B and that the "handedness" and helical pitch (i.e. distance between adjacent helical circumferences) can be controlled by these parameters together with appropriate selection of oblique angle θ. First cantilever portion 92A of structure 90 is useful to orient the direction of the helix formed by second cantilever portion 92B. In some embodiments, first cantilever portion 92A is not necessary. In the illustrated embodiment, the pitch, post length and gap dimension of posts 94B in second cantilever portion 92B is uniform along second longitudinal direction 34B to result in an at least approximately ideal helical shape. In other embodiments, these parameters can be varied to form general spiral shapes which may have varying curvature, varying helical pitch, varying handedness and the like. In some embodiments, second cantilever portion 92B of structure 90 may be provided with protrusions (not shown) on one or both of its transverse sides. Such protrusions may serve a function similar to that of protrusions 28—i.e. to prevent stiction between second cantilever portion 92B and the substrate, particularly, where during self-assembly a transverse side of second cantilever portion 92B may actually face toward the substrate. Helical and other spiral shapes can be useful for antenna applications as described in more detail below.

Those skilled in the art will by now appreciate that structures similar to those described herein can be fabricated to provide an extremely wide variety of self-assembling structures capable of inter-layer stress induced self-assembly and corresponding curvature into the out-of-plane direction. By way of non-limiting example, such structures can be provided with, inter alia:

- curving portions and/or non-curving (i.e. relatively stiff) portions with various shapes wherein curving portions may comprise longitudinally spaced apart posts and/or longitudinally spaced apart post and spans which are spaced apart from the cantilever arm and wherein non-curving portions may comprise longitudinally continuous stiffeners or may be provided without a second structural layer;
- single or multiple curving portions and/or non-curving (i.e. relatively stiff) portions within a single self-assembling structure;
- curving portions which self-assemble to subtend various angles which may be controlled by appropriate selection of parameters such as pitch, post length and gap dimension;
- curving portions having different and/or varying radii of curvature which may be controlled by appropriate selection of parameters such as pitch, post length and gap dimension; and
- curving portions which curve at oblique angles with respect to the longitudinal direction of their respective cantilever.

These aspects of the self-assembling structures described herein which provide design flexibility together with the fact that these structures may extend in the out-of-plane direction to provide separation between the structures and the substrate (e.g. thermal and/or electromagnetic separation) suggest a number of suitable applications. One particular application is to provide antennas which make use of the self-assembling structures described herein to provide separation between the antenna and the substrate and to thereby reduce losses associated with lossy substrates common to CMOS and other microelectronic fabrication processes. This may involve orientation of an antenna (e.g. a monopole) in a direction that extends at least partially in the out-of-plane direction 32 (see FIGS. 2A, 4A) to provide electromagnetic waves having a similar polarization which extends at least partially in the out-of-plane direction 32.

Antennas typically incorporate conductive elements (antenna conductors) for sending and/or receiving electromagnetic energy. Fabricating an antenna using a structure described herein may involve application of metal to the structure to provide a suitable antenna conductor or otherwise making at least a portion of the structure conductive to provide a suitable antenna conductor. In some embodiments, metal may be coated atop the structure—e.g. after application of the second structural layer. In some embodiments, metal may be deposited after the structure has self-assembled. In other embodiments, metal may be applied between structural layers or beneath the first structural layer. In still other embodiments, the material used to fabricate first and/or second structural layers may itself be conductive or may be doped with other suitably conductive materials (e.g. electrically conductive polymers, polymers doped with conductive nano-particles and the like). In general, while this description provides a number of techniques for providing antenna conductors, the invention should be understood to incorporate any suitable method of providing the self-assembling structures described herein with conductive elements having suitably high conductivity (i.e. antenna conductors).

In one particular embodiment, the structures described herein are used to provide monopole antennas. For example, such monopole antennas may be provided by structures similar to that of FIGS. 2A-2B or 4A-4C. In other embodiments, the structures described herein are used to provide relatively wide band monopoles, for example, using structures similar to those of FIGS. 5A-5C. In still other embodiments, the structures described herein are used to provide helical (or spiral) shaped antennas for eliptical polarization or quasi-eliptical polarization (e.g. using structures similar to that of FIGS. 8A and 8B). It may be convenient to apply a conductive material (e.g. metal) to the structure after the structure has self-assembled (i.e. after the completion of FIG. 1K (in method 10) or after the completion of FIG. 3B (in method 100)). The application of conductive material may comprise a blanket application. By way of non-limiting example, such blanket application may involve processes such as sputtering, evaporation, chemical vapor deposition and electroplating.

Figure 9A:
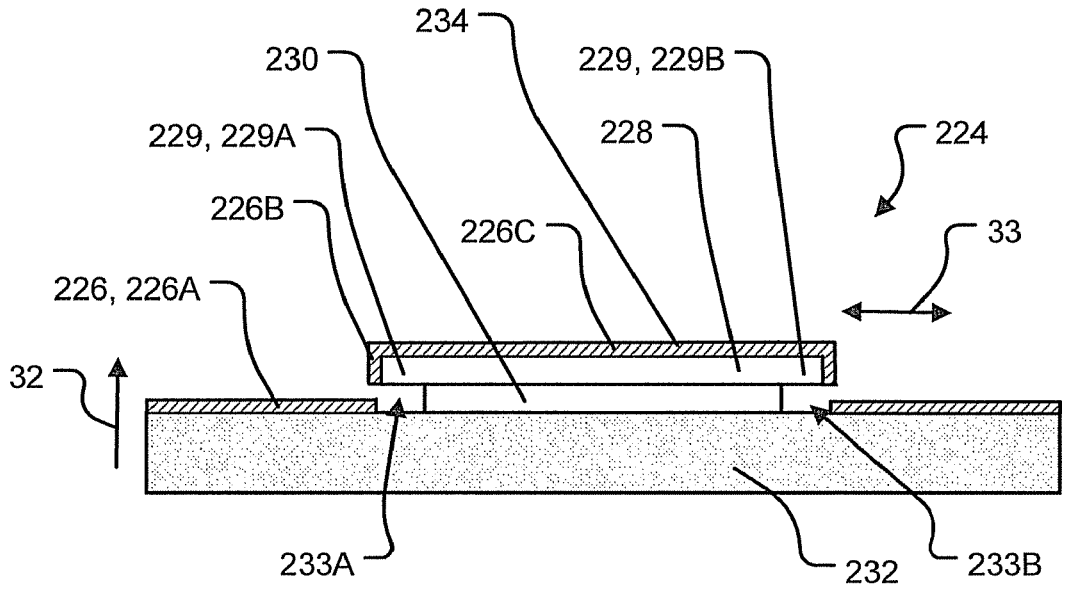
FIGS. 9A and 9B are respectively partial rear cross-sectional views of structures according to particular embodiments of the invention to which conductive layers have been applied for electrical separation from, and for electrical contact with, the substrate.

In some embodiments, it is desirable to isolate the antenna conductor from conductor applied to the substrate (e.g. in a blanket application). In such embodiments, overhanging structures may be provided to prevent metal or other conductive material applied to the structure from contacting metal or other conductive material applied to the substrate. FIG. 9A is a partial rear cross-sectional view of an antenna structure 224 to which a conductive layer 226 has been applied by a blanket application (e.g. sputtering) according to a particular embodiment of the invention. Some detail has been left out of the FIG. 9A illustration for clarity.

In the illustrated embodiment, structure 224 comprises an anchor 230 and structural layer 228. Structural layer 228 comprises at least one overhanging feature 229 which overhangs anchor 230 (i.e. which extends in one of the in-plane directions beyond the in-plane extent of anchor 230). In the illustrated embodiment, structure 224 comprises a pair of overhanging features 229A, 229B which extend beyond anchor 230 in opposing transverse directions 33. Structure 224 may additionally or alternatively comprises a single transverse overhanging feature or a longitudinally overhanging feature.

When metal 226 is applied to structure 224, it form a metal layer 226A on substrate 232, a metal layer 226B on the sides of structural layer 228 and metal layer 226C on top of structural layer 228. Metal layers 226B, 226C on structure 224 provide antenna conductor 234. Because of overhanging features 229A, 229B, there is no contact between substrate metal layer 226A and the metal layers 226B, 226C applied to the sides and top of structural layer 228—i.e. no metal reaches regions 233A, 233B as they are covered by overhanging structures 229A, 229B. In this manner, conductive material 226C applied to structure 224 to provide antenna conductor 234 is electrically isolated from conductive material 226A applied to substrate 232.

Figure 9B:
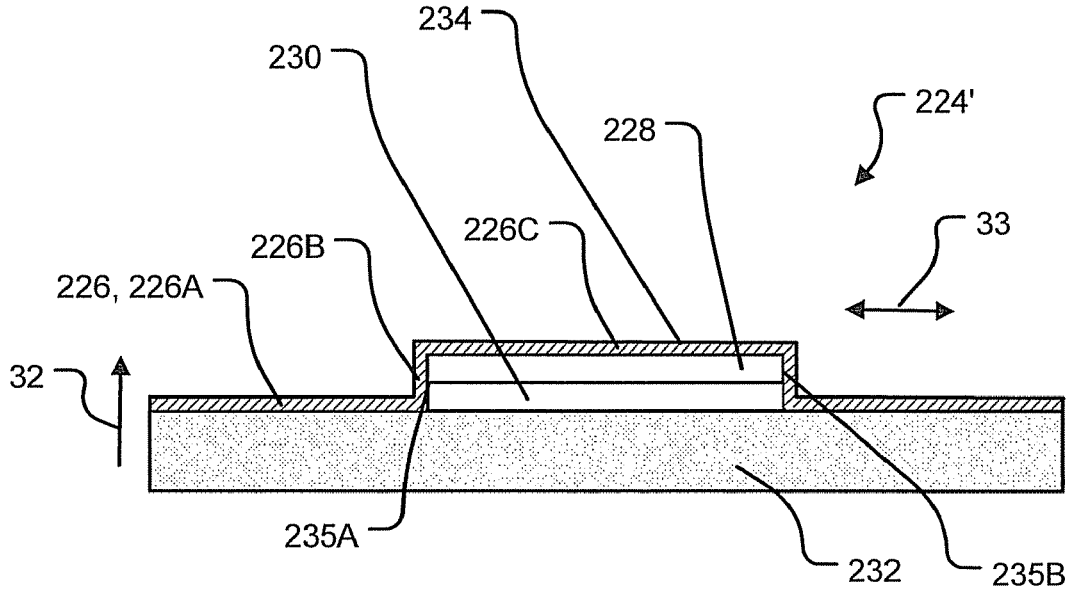

In some embodiments, it is desirable to provide electrical contact between the antenna conductor and the conductor applied to the substrate (e.g. in a blanket application). Such electrical contact may be obtained by providing one or more out-of-plane surfaces that are sufficiently flat (i.e. non-overhanging). FIG. 9B is a partial rear cross-sectional view of an antenna structure 224' to which a conductive layer 226 has been applied by a blanket application (e.g. sputtering) according to a particular embodiment of the invention. Some detail has been left out of the FIG. 9B illustration for clarity.

Structure 224' is similar to structure 224 in many respects and similar reference numerals are used to describe similar features. Structure 224' differs from structure 224 in that structural layer 228 and anchor 230 have generally co-planar (i.e. non-overhanging) transverse sidewalls 235A, 235B. When metal 226 is applied to structure 224', metal layer 226B on transverse sidewalls 235A, 235B extends between substrate metal layer 226A and metal layer 226C on top of structural layer 228. In this manner, conductive material 226C applied to structure 224 to provide antenna conductor 234 is electrically connected to conductive material 226A applied to substrate 232.

Figure 9C:
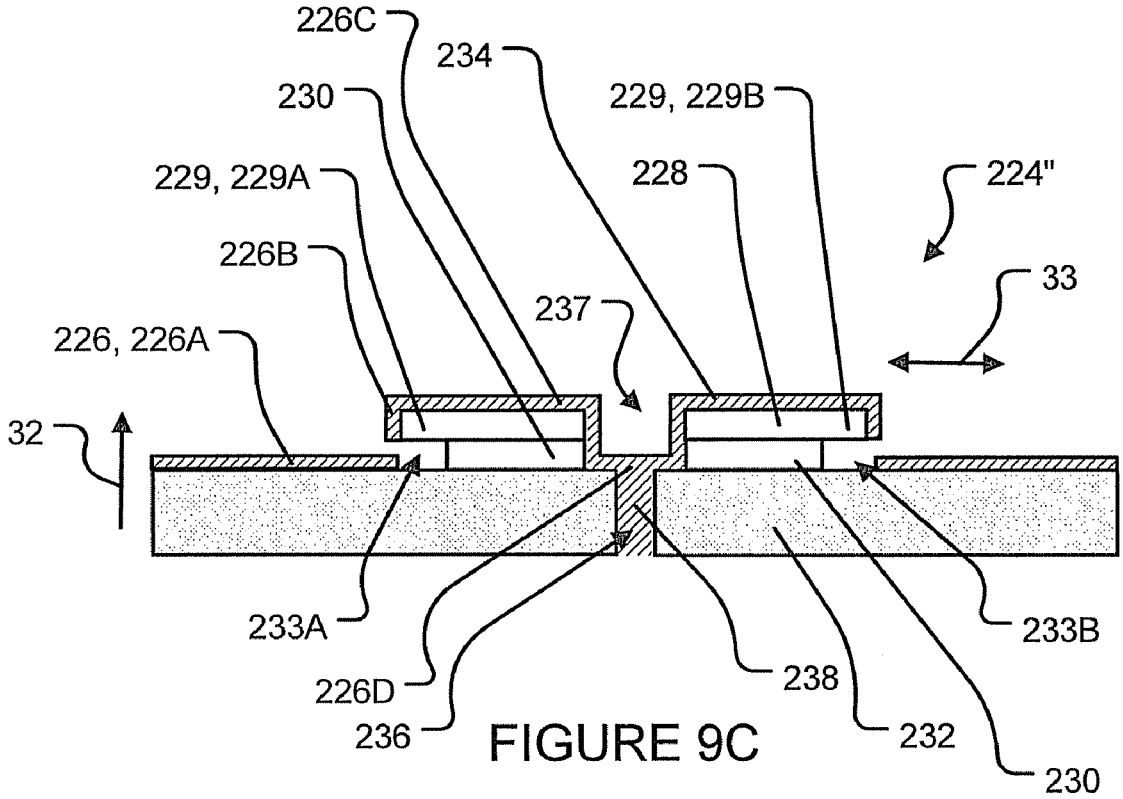
FIG. 9C is a partial rear cross-sectional view of structure according to a particular embodiment of the invention to which a conductive layer has been applied wherein the conductive layer is in electrical contact with additional integrated electronic components.

In some embodiments, it is desirable to provide electrical contact between the antenna conductor and other electronic components which may be integrated on the same chip. By way of non-limiting example, such other electronic components may be CMOS or GaAs components and may be lithographically integrated beneath the substrate upon which the antenna is created. FIG. 9C is a partial rear cross-sectional view of an antenna structure 224" according to a particular embodiment of the invention to which a conductive layer 226 has been applied wherein the conductive layer is in electrical contact with additional integrated electronic components. Some detail has been left out of the FIG. 9C illustration for clarity.

Structure 224" is similar to structure 224 (FIG. 9A) in many respects and similar reference numerals are used to describe similar features. In the FIG. 9C embodiment, via 236 is provided through substrate 232. Via 236 may be filled with conductive material 238 prior to the fabrication of structure 224", although this is not necessary. Conductive material 238 may be in electrical contact with one or more other electronic components (not shown). Such electrical components may be integrated onto the same chip as structure 224". By way of non-limiting example, such electrical components may comprise CMOS or GaAs components which may be located below substrate 232.

Structure 224" differs from structure 224 in that a via 237 is patterned through anchor 230 and structural layer 228. In some embodiments, via 237 may be provided by UV exposure through a suitable mask, although other methods may also be used to provide via 237. When metal layer 226 is applied to structure 224", it coats substrate 232 to provide substrate metal layer 226A, the sides of structural layer 228 to provide metal layer 226B and the top of structural layer 228 to provide top metal layer 226C. Metal is also deposited in via 237 to create metal layer 226D. Metal layer 226D is in contact with metal 238 in via 236. In this manner, the antenna conductor provided by metal layer 226C is in electrical contact with metal 238 and any electronic components which may also be in contact with metal 238.

An alternative to providing an antenna conductor in a blanket application after self-assembly involves adding an antenna conductor (e.g. metal) during the fabrication of the self-assembling structure and prior to self-assembly. Such conductive layers can be applied and patterned as required. By way of non-limiting example, such conductive layers can be applied under the first structural layer, between the first and second structural layers and/or atop the second structural layer. Application of conductive material may involve sputtering, evaporation, chemical vapor deposition and/or electroplating, for example. By way of non-limiting example, patterning such conductive layers may comprise a suitable combination of application of photoresist, patterning photoresist, application of conductive material, conventional etching and reactive ion etching (RIE), for example. Application of conductive materials during fabrication of the self-assembling structure and prior to self-assembly may provide the advantage of providing more uniform thickness of conductive material, since the structure is relatively planar prior to self-assembly. The application of conductive material prior to self-assembly may also influence the self-assembly process.

As discussed above, particular embodiments of the invention provide self-assembling antennas. Such antennas may be provided as relatively narrow band, linearly polarized monopoles (e.g. by structures similar to those of FIGS. 2A-2B or 4A-4C) or as relatively wide band antennas (e.g. by structures similar to those of FIGS. 5A-5C) or as helical (or spiral) shaped antennas for eliptical or quasi-eliptical polarization (e.g. by structures similar to those of FIGS. 8A and 8B).

Typically, although not necessarily, it is desirable to fabricate antennas (e.g. monopoles) with a length that is approximately equal to $\lambda/4$ where $\lambda$ is the free space wavelength corresponding to the center frequency of interest. Designing an antenna for a particular central frequency may involve selecting a length that is in a range of $\lambda/4\pm20\%$, for example. Self-assembling antenna structures according to particular embodiments of the invention may be provided with longitudinal lengths on the order of 10 μm-5 cm. Based on the $\lambda/4$ design characteristic, such structure lengths correspond to monopoles for center frequencies in a range of 1.5 GHz-7.5 THz. In some embodiments, monopoles may be provided for center frequencies in a range of 40-75 GHz (i.e. lengths of approximately 1-1.875 mm. In particular embodiments, antennas may be designed to have lengths suitable for a center frequencies in the widely available spectrum surrounding the 60 GHz range (i.e. lengths of approximately 1.25 mm).

Helical (or spiral) antennas can offer advantages over linear antennas (monopoles, dipoles) including wider fractional bandwidth (e.g. the ratio between the bandwidth and resonant frequency) and circular polarization. Helical (or spiral) antennas may function in two modes of operations: normal mode (also referred to as broadside) wherein the maximum radiation is oriented along the normal line to the helical axis and axial mode (also referred to as end-fire) wherein the maximum radiation is oriented along the axis of the helix. In the normal mode, the radiation pattern is similar to that of a monopole. The axial mode may provide elliptical polarization over a relatively wide bandwidth and with a relatively high efficiency.

To operate in the axial mode, the circumference of the helix and the separation between different turns (i.e. the helical pitch) are preferably relatively large fractions of the wavelength. For relatively pure circular polarization, the ratio between the helix circumference and the wavelength of the center wavelength ($c:\lambda_0$) is preferably close to unity (e.g. 0.75-1.33) and the spacing between turns (i.e. the helical pitch) is preferably around quarter wavelength ($\lambda/4$). By way of non-limiting example, for operation centered around 60 GHz, the helical pitch may be in a range of 1 mm±15% and the circumference of the helix may be about 5 mm±15%.

In particular embodiments, it is desirable to provide an antenna conductor (e.g. metal or other suitable conductor) having a thickness on the order of the skin depth (or greater) at the frequency of interest. In the frequency range of 40-75 GHz for an antenna conductor comprising primarily gold, the desired conductive layer thicknesses are on the order of 0.29-0.39 μm or greater. At a center frequency of 60 Ghz, such conductive layer thickness is on the order of 250 nm or greater. The fabrication techniques described above are capable of providing such conductive layer thicknesses.

As mentioned above, the ability of the structures described herein to extend away from the substrate in the out-of-plane direction can separate the antenna from the substrate. This separation can provide increased antenna efficiency since there is reduced dissipation of energy in lossy substrates. As discussed above, substrates for CMOS and other technologies that support microelectronic integration are typically somewhat conductive and therefore somewhat lossy.

When designing antennas using the structures described above, it is desirable to consider the dielectric nature of the structure (e.g. the cantilever arm) that supports the antenna conductor and its effect on the antenna characteristics. Typically, the dielectric material used to provide support for the antenna structure will have a higher permittivity than air. Consequently, the wavelength will be slightly smaller and the effective length of the monopole is slightly smaller than the actual length of the antenna conductor and the resonance frequency of the structure will be slightly higher than the ideal monopole with the same length of antenna conductor. In addition, the existence of curvature of the structure at or near the substrate will also impact the resonant frequency.

In particular embodiments, an array of monopoles may be provided with varying tilt angles (i.e. where the tilt angle θ can be measured from an axis that is normal to the substrate). Such embodiments can be used in polarization diversity systems where different tilt angle antennas serve as radiating elements to provide different pure polarizations. Furthermore, the actual out-of-plane space occupied by antennas can be controlled by providing a non-zero tilt angle θ. Helical-shaped or spiral shaped structures (FIGS. 8A and 8B) can also be fabricated to provide polarization diversity.

The bandwidth of antennas fabricated according to the invention may be controlled by controlling the aspect ratio (length:width) and/or the shape of the structures. For example, the semi-triangular structures with angled edges (FIGS. 5A-5C) may provide a wide range of lengths and a correspondingly wide range of resonant frequencies.

It will be appreciated that the structures described herein provide the ability to raise antennas, such that at least a portion of the antenna is separated from the substrate. Furthermore, suitable fabrication of the structures described herein (e.g. by appropriate selection of pitch, post length, gap dimension and post and span thickness and by appropriate selection of cantilever arm length and shape) can be used to control a number of antenna parameters (e.g. length, elevation, azimuthal angle, elevation angle and profile shape). In particular embodiments, arrays of antennas having different azimuthal and/or elevation angles (orthogonal and/or oblique) can be simultaneously fabricated in proximity to one another with minimal coupling therebetween. Since different angles provide a different polarization basis, the individual antennas of such arrays can be used as the radiating elements of polarization diversity systems. In some embodiments, the shape of the antennas can be designed to control bandwidth (e.g. semi-triangular shaped antennas) or their polarization (e.g. helical or spiral shaped antennas)

Experiments

The inventors fabricated a number of non-limiting experimental examples of monopole antennas according to the method 110 described above. The material used for the structural layers was SU-8. The monopole antennas comprised a number lengths ranging from 1.25 mm to 10 mm and various tilt angles from θ=0°-75°. Antenna conductor in the form of metal (Cr and Au) was applied by sputtering after self-assembly. With an initial Cr layer with a thickness on the order of 30 nm followed by an Au layer with a thickness on the order of 270 nm. Transmission lines of 50Ω impedance were designed by known methods for feeding the antennas. The ground plane size of the experimental prototypes ranged from 10 mm×10 mm to 20 mm×20 mm. A calibration transmission line was fabricated on each die by techniques known in the art so that the feed line effect could be calibrated out. The transmission line was calibrated. For the measurements shown below, the effect of the transmission line is removed from the measurement to give a better indication of antenna performance.

Tilt Angle

Figure 10A:
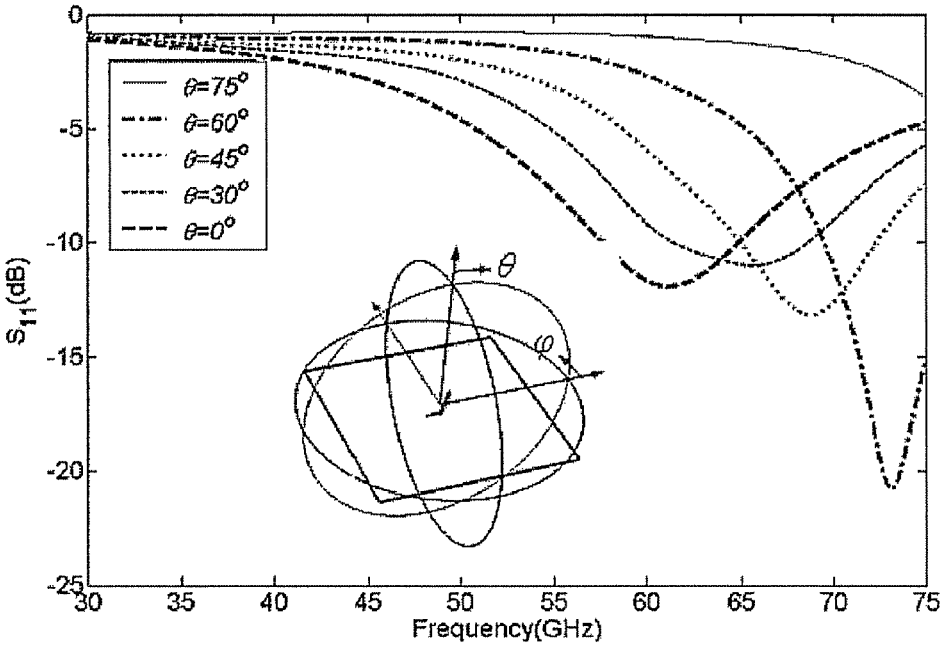
FIG. 10A is a plot showing experimental return loss for monopole antennas according to example embodiments for various tilt angles.
Figure 10B:
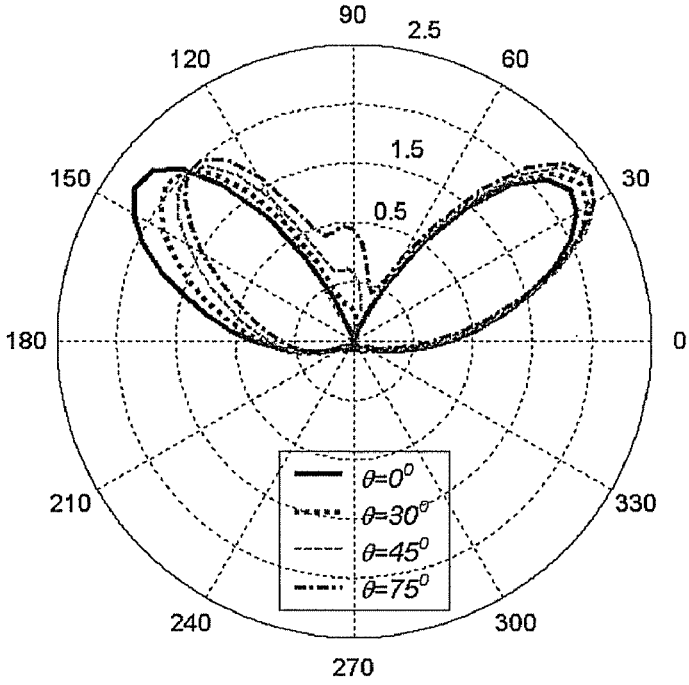
FIG. 10B is a plot showing experimental radiation patterns for monopole antennas according to example embodiments for various tilt angles.

The inventors have determined that the tilt angle θ (measured from an axis that is normal to the substrate) of any given monopole impacts both its impedance and its radiation pattern. These impacts of tilt angle θ are shown in FIGS. 10A and 10B respectively. FIG. 10A plots the return loss of a number of monopoles fabricated in accordance with the techniques described above and having various tilt angles. FIG. 10A shows that the resonant frequency of the antenna gets higher as the antenna tilt angle θ is increased. FIG. 10B plots the radiation pattern of a number of antennas having various tilt angles θ and shows that the power beam of the antenna can be controlled by varying the tilt angle θ. With increasing tilt angle θ, the beam angle is decreased up to 20°.

Impedance and Return Loss

Figure 11A:
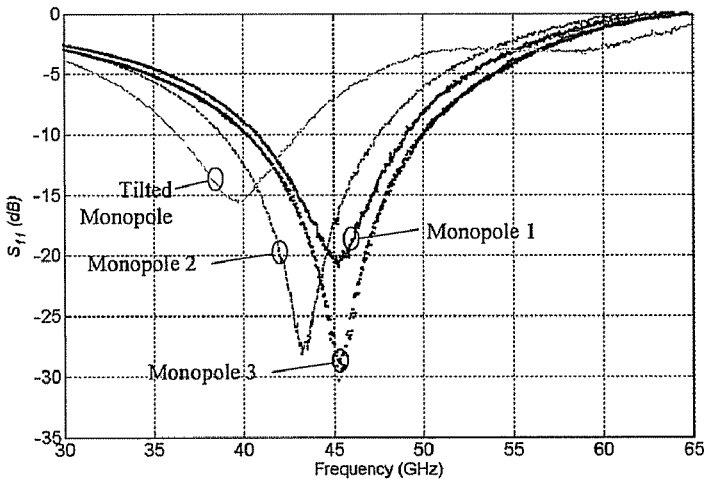
FIGS. 11A and 11B are plots showing experimental return loss for a number of monopole antennas according to a number of example embodiments.
Figure 11B:
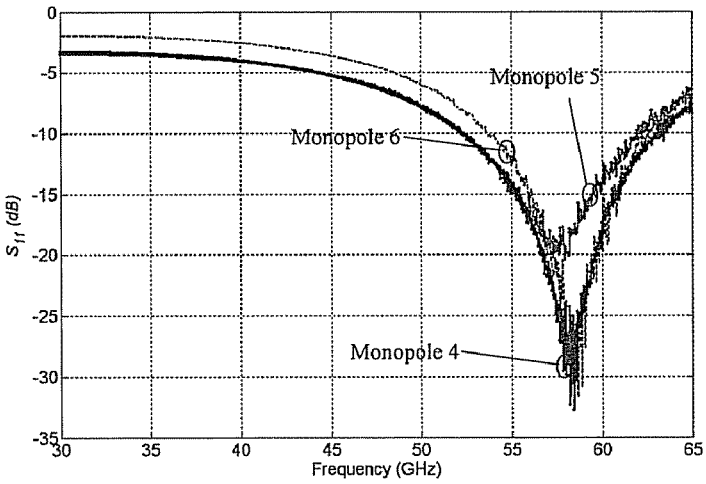

FIGS. 11A and 11B depict the return loss for a number of the experimentally fabricated monopoles described above. The FIG. 11A return loss plots show results for three monopoles extending at least approximately in the out-of-plane direction (i.e. θ=0°) having lengths of 1.677 mm and widths of 0.2 mm (referred to in FIG. 11A as monopoles 1, 2 and 3) and for a oblique angle monopole (θ=45°) of length 1.327 mm and width 0.2 mm (referred to in FIG. 11A as tilted monopole). The FIG. 11B return loss plots show results for three monopoles extending at least approximately in the out-of-plane direction (i.e. θ=0°) having lengths of 1.250 mm and widths of 0.2 mm (referred to in FIG. 11B as monopoles 4, 5 and 6 de-embedded).

Figure 11C:
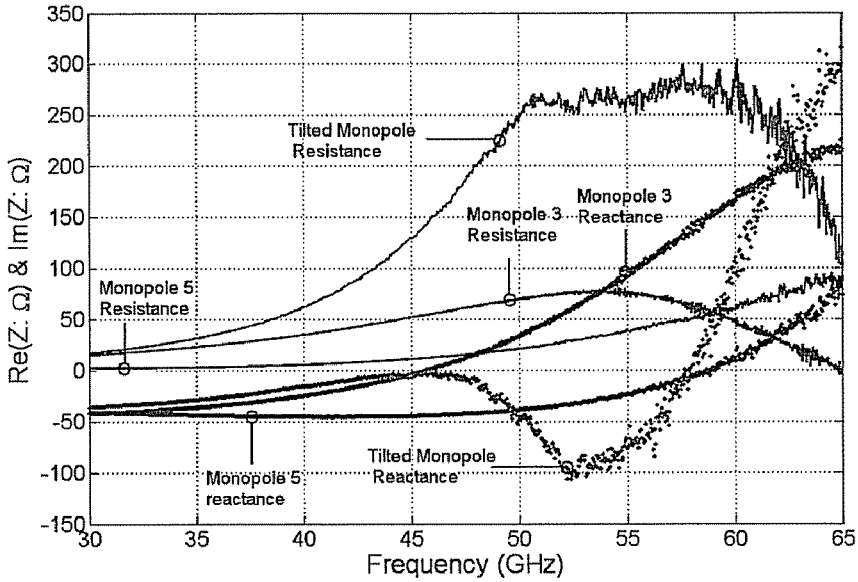
FIG. 11C is a plot showing experimental impedance for a number of monopole antennas according to a number of example embodiments.

FIG. 11C shows the impedance for the tilted monopole (θ=45°, length=1.327 mm and width=0.2 mm) and for monopole 3 (θ=0°, length=1.677 mm and width=0.2 mm) and 5 (θ=0°, length=1.250 mm and width=0.2 mm).

Radiation Efficiency and Gain

Figure 11D:
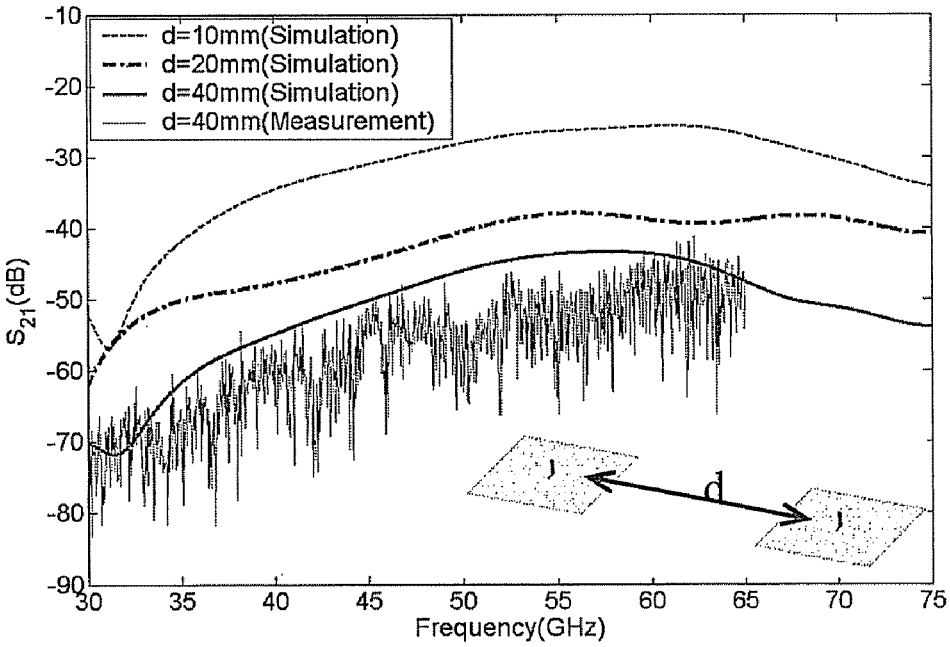
FIG. 11D is a plot showing experimental transmission characteristics between a pair of monopole antennas fabricated according to an example embodiment.

The transmission characteristics between a pair of identical 60 GHz monopoles 40 mm separation (~8λ) were measured. Then the power gain was calculated using a 2-port measurement. The results of this experiment are depicted in FIG. 11D, which shows a transmission gain of −45 dB. This −45 dB transmission gain is significantly higher than prior art planar antennas. The transmission gain of the antenna can be written as:

$$G_a = \frac{|S_{21}|^2}{(1-|S_{11}|^2)(1-|S_{22}|^2)} = G_T G_R \left(\frac{\lambda}{4\pi R}\right)^2$$

Figure 11E:
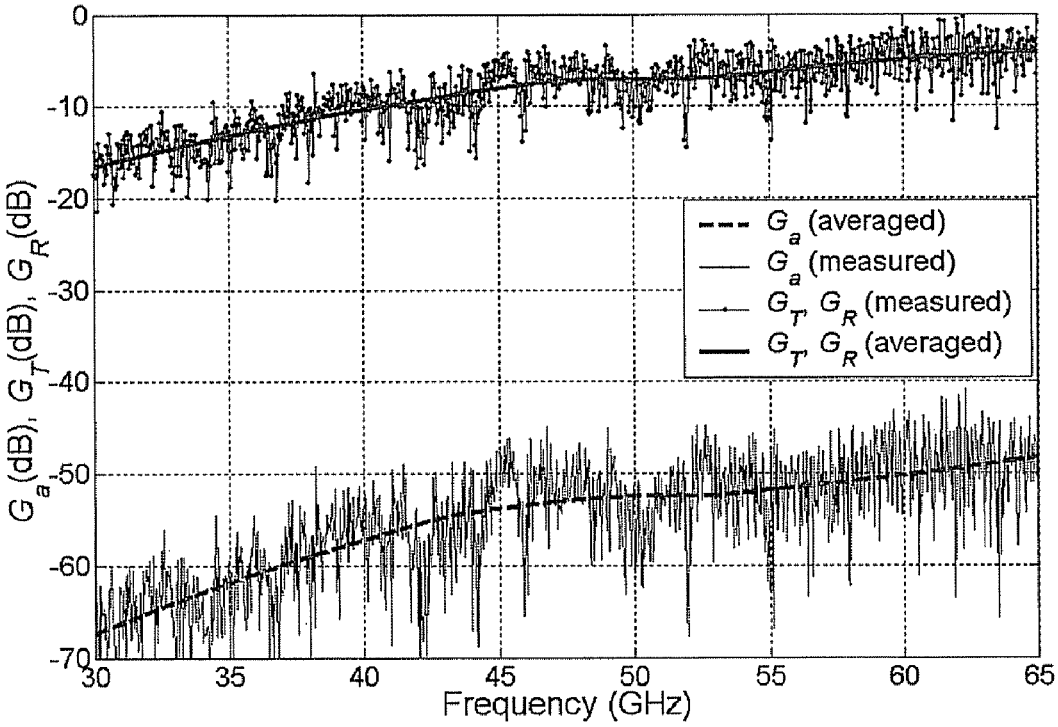
FIG. 11E is a plot showing the power gain parameter ($G_a$) of the FIG. 11D antenna system.

Here, $G_a$ is the power gain, which is defined as the power available to the receiving antenna, when mismatch loss is discarded. $G_R$ and $G_T$ are the gains of receiving and transmitting antennas, R is distance between antennas and λ is the wavelength. FIG. 11E depicts $G_a$ along the frequency band of interest together with the receiving and transmitting antenna gains ($G_T$ and $G_R$), assuming both gains are equal.

As will be apparent to those skilled in the art in the light of the foregoing disclosure, many alterations and modifications are possible in the practice of this invention without departing from the spirit or scope thereof. For example:

the helical shaped structures described above are shaped like cylindrical helices—i.e. they trace out a shape that conforms to the shape of a cylinder. In other embodiments, helical shaped structures could be provided with shapes such as conical helices or spherical helices or, more generally, cylindrical, conical or spherical spirals.

a plurality of helical or spiral shaped structures may be fabricated adjacent one another and may be configured so that after self assembly, the spiralling (or helical) cantilever arms of the plurality of structures may be co-axial with one another—e.g. a pair of cylindrical helices may be designed to circumscribe the same imaginary cylindrical surface.

What is claimed is:

1. A lithographically fabricated apparatus capable of self-assembly to extend at least in part in an out-of-plane direction, the apparatus comprising:

a cantilever arm anchored to a substrate at one of its ends and fabricated to provide a cantilever portion that extends from the anchor in a longitudinal direction that is generally parallel to the substrate, the cantilever portion spaced apart from the substrate;

at least one post fabricated atop the cantilever portion, the post occupying an in-plane cross-sectional area that is less than an in-plane cross-sectional area of the cantilever portion, a volume of the post shrinking from a first volume to a second volume, less than the first volume, during fabrication thereof; wherein shrinking of the post from the first volume to the second volume causes stress between the post and the cantilever arm, the stress causing, at least in part, the cantilever portion to bend from an in-plane orientation extending in the longitudinal direction to a self-assembled orientation extending at least in part in an out-of-plane direction away from the substrate.

2. An apparatus according to claim 1 comprising a plurality of posts fabricated atop the cantilever portion at locations spaced apart from one another in the longitudinal direction, each post shrinking from a first post volume to a second post volume, less than the first post volume, during fabrication thereof and wherein shrinking in volume of the posts from the first post volume to the second post volume causes stress between the posts and the cantilever arm, the stress causing, at least in part, the cantilever portion to bend from the in-plane orientation to the self-assembled orientation.

3. An apparatus according to claim 2 comprising one or more spans, each span extending between longitudinally adjacent posts at a location spaced apart from the cantilever arm and each span shrinking from a first span volume to a second span volume, less than the first span volume, during fabrication thereof and wherein shrinking in volume of each span from its first span volume to its second span volume causes span-induced stress on the cantilever portion, the span-induced stress causing, at least in part, the cantilever portion to bend from the in-plane orientation to the self-assembled orientation.

4. An apparatus according to claim 2 wherein the self-assembled orientation comprises an orientation wherein a curved part of the cantilever portion curves away from the substrate.

5. An apparatus according to claim 4 wherein the self-assembled orientation comprises an orientation wherein a straight part of the cantilever portion extends in a generally straight direction, the straight direction extending in the out-of-plane direction away from the substrate.

6. An apparatus according to claim 4 wherein the curved part of the cantilever portion is curved to subtend an angle in a range of 75°-105° between the straight direction and the longitudinal direction.

7. An apparatus according to claim 4 wherein the curved part of the cantilever portion curves about a transverse axis with a generally constant radius of curvature, the transverse axis extending in a transverse direction that is generally orthogonal to both the longitudinal direction and the out-of-plane direction.

8. An apparatus according to claim 5 wherein the plurality of posts are located on the curved part of the cantilever portion.

9. An apparatus according to claim 8 comprising a stiffener fabricated atop the straight part of the cantilever portion, the stiffener fabricated to be longitudinally continuous and, when the cantilever portion bends to the self-assembled orientation, the stiffener extends substantially continuously in the straight direction.

10. An apparatus according to claim 5 wherein the straight part of the cantilever portion comprises transverse edges which are generally parallel.

11. An apparatus according to claim 5 wherein the straight part of the cantilever portion comprises transverse edges which diverge from one another as they extend away from the anchor.

12. An apparatus according to claim 4 wherein the curved part of the cantilever portion comprises transverse edges which diverge from one another as they extend away from the anchor.

13. An apparatus according to claim 2 wherein each post is generally cuboid in shape to provide sides which, prior to bending of the cantilever portion, extend in the longitudinal direction, in the out-of-plane direction generally orthogonal to the longitudinal direction and in a transverse direction generally orthogonal to both the out-of-plane direction and the longitudinal direction and wherein the posts increase a stiffness of the apparatus in the transverse direction.

14. An apparatus according to claim 2 wherein one or more posts are generally parallelepiped shaped to provide at least one side which, prior to bending of the cantilever portion, extends in an angular direction that forms an oblique angle with the longitudinal direction.

15. An apparatus according to claim 14 wherein the self-assembled orientation comprises an orientation wherein a curved part of the cantilever portion has a spiral shape in which the curved part curves about an axis of curvature that varies in orientation over a length of the curved part.

16. An apparatus according to claim 2 wherein the self-assembled orientation comprises an orientation wherein a curved part of the cantilever portion curves with a radius of curvature that varies along a length of the curved part.

17. An apparatus according to claim 1 wherein the cantilever portion comprises a first cantilever portion which is fabricated to extend in a first longitudinal direction that is generally parallel to the substrate and a second cantilever portion which is fabricated to extend in a second longitudinal direction, different from the first longitudinal direction, that is generally parallel to the substrate and wherein the apparatus comprises:

a plurality of first portion posts fabricated atop the first cantilever portion and spaced apart from one another in the first longitudinal direction, each first portion post shrinking from a first post volume to a second post volume, less than the first post volume, during fabrication thereof and wherein shrinking in volume of the first portion posts from the first post volume to the second post volume causes stress between the first portion posts and the first cantilever portion, the stress causing, at least in part, the first cantilever portion to bend from the first longitudinal direction to a first self-assembled orientation extending at least in part in the out-of-plane direction away from the substrate;

a plurality of second portion posts fabricated atop the second cantilever portion and spaced apart from one another in the second longitudinal direction, each second portion post shrinking from an initial post volume to a subsequent post volume, less than the initial post volume, during fabrication thereof and wherein shrinking in volume of the second portion posts from the initial post volume to the subsequent post volume causes stress between the second portion posts and the second cantilever portion, the stress causing, at least in part, the second cantilever portion to bend from the second longitudinal direction to a second self-assembled orientation.

18. An apparatus according to claim 17 wherein each of the second portion posts is generally parallelepiped shaped to provide at least one side which, prior to bending of the second cantilever portion, extends in an angular direction that forms an oblique angle with the second longitudinal direction.

19. An apparatus according to claim 18 wherein the second self-assembled orientation comprises an orientation wherein a curved part of the second cantilever portion has a spiral shape in which the curved part curves about an axis of curvature that varies in orientation over a length of the curved part.

20. An apparatus according to claim 2 wherein the posts are fabricated from a polymer and the shrinking in volume of the posts from the first post volume to the second post volume is associated with curing of the polymer.

21. An apparatus according to claim 20 wherein the polymer comprises at least one of: SU-8 and polyimide.

22. An apparatus according to claim 2 comprising an antenna conductor which extends along at least a portion of the cantilever portion.

23. An apparatus according to claim 22 wherein the antenna conductor is applied to the apparatus after the cantilever portion has bent from the in-plane orientation to the self-assembled orientation.

24. An apparatus according to claim 23 wherein the antenna conductor is applied to the apparatus by at least one of: sputtering, evaporation, chemical vapor deposition and electroplating.

25. An apparatus according to claim 22 wherein the antenna conductor is applied to the apparatus after fabrication of the posts but before the cantilever portion has bent from the in-plane orientation to the self-assembled orientation.

26. An apparatus according to claim 22 wherein the antenna conductor is applied to the apparatus in at least one of: between the cantilever arm and the posts; and under the cantilever arm.

27. An apparatus according to claim 3 wherein the self-assembled orientation comprises an orientation wherein a curved part of the cantilever portion curves away from the substrate.

28. An apparatus according to claim 27 wherein the self-assembled orientation comprises an orientation wherein a straight part of the cantilever portion extends in a generally straight direction, the straight direction extending in the out-of-plane direction away from the substrate.

29. An apparatus according to claim 27 wherein the curved part of the cantilever portion comprises transverse edges which diverge from one another as they extend away from the anchor.

30. An apparatus according to claim 28 wherein the straight part of the cantilever portion comprises transverse edges which diverge from one another as they extend away from the anchor.

31. An apparatus according to claim 3 wherein one or more posts are generally parallelepiped shaped to provide at least one side which, prior to bending of the cantilever portion, extends in an angular direction that forms an oblique angle with the longitudinal direction.

32. An apparatus according to claim 31 wherein the self-assembled orientation comprises an orientation wherein a curved part of the cantilever portion has a spiral shape in which the curved part curves about an axis of curvature that varies in orientation over a length of the curved part.

33. An apparatus according to claim 17 comprising: one or more first spans, each first span extending between longitudinally adjacent first portion posts at a location spaced apart from the first cantilever portion and each first span shrinking from a first span volume to a second span volume, less than the first span volume, during fabrication thereof and wherein shrinking in volume of each first span from its first span volume to its second span volume causes a first span-induced stress on the first cantilever portion, the first span-induced stress causing, at least in part, the first cantilever portion to bend from the first longitudinal direction to the first self-assembled orientation; and one or more second spans, each second span extending between longitudinally adjacent second portion posts at a location spaced apart from the second cantilever portion and each second span shrinking from an initial span volume to a subsequent span volume, less than the initial span volume, during fabrication thereof and wherein shrinking in volume of each second span from its initial span volume to its subsequent span volume causes a second span-induced stress on the second cantilever portion, the second span-induced stress causing, at least in part, the second cantilever portion to bend from the second longitudinal direction to the second self-assembled orientation.

34. An apparatus according to claim 33 wherein the second self-assembled orientation comprises an orientation wherein a curved part of the second cantilever portion has a spiral shape in which the curved part curves about an axis of curvature that varies in orientation over a length of the curved part.

35. An apparatus according to claim 3 wherein the posts and the spans are fabricated from a polymer and the shrinking in volume of the posts from the first post volume to the second post volume and the shrinking in volume of the spans from the first span volume to the second span volume are associated with curing of the polymer.

36. An apparatus according to claim 3 comprising an antenna conductor which extends along at least a portion of the cantilever portion.

37. An apparatus according to claim 3 fabricated by surface micromachining.

38. A method for lithographically fabricating a self-assembling structure, the method comprising:

fabricating a cantilever arm anchored to a substrate at one of its ends to provide a cantilever portion that extends from the anchor in a longitudinal direction that is generally parallel to the substrate, the cantilever portion spaced apart from the substrate;

introducing stress to the cantilever arm at a plurality of locations spaced apart from one another in the longitudinal direction, the stress causing, at least in part, the cantilever portion to bend from an in-plane orientation extending in the longitudinal direction to a self-assembled orientation extending at least in part in an out-of-plane direction away from the substrate.

39. A method according to claim 38 wherein introducing stress to the cantilever arm at the plurality of longitudinally spaced apart locations comprises fabricating a plurality of posts atop the cantilever portion at the longitudinally spaced apart locations and treating the posts to cause them to contract.

40. A method according to claim 39 wherein introducing stress to the cantilever arm at the plurality of longitudinally spaced apart locations comprises fabricating one or more spans, each span extending between a pair of longitudinally adjacent posts at a location spaced apart from the cantilever portion and treating the one or more spans to cause the one or more spans to contract.

41. A method according to claim 40 wherein the posts and spans comprise polymer and treating the posts and the one or more spans to cause them to contract comprises curing the polymer.

42. A method according to claim 39 wherein the self-assembled orientation comprises an orientation wherein a curved part of the cantilever portion curves away from the substrate and a straight part of the cantilever portion extends in a generally straight direction, the straight direction extending in the out-of-plane direction away from the substrate.

43. A method according to claim 40 wherein the self-assembled orientation comprises an orientation wherein a curved part of the cantilever portion curves away from the substrate and a straight part of the cantilever portion extends in a generally straight direction, the straight direction extending in the out-of-plane direction away from the substrate.

44. A method according to claim 40 wherein introducing stress to the cantilever arm at the plurality of longitudinally spaced apart locations comprises, at one or more of the longitudinally spaced apart locations, introducing stress that is concentrated at an orientation that forms an oblique angle with the longitudinal direction.

45. A method according to claim 44 wherein the self-assembled orientation comprises an orientation wherein a curved part of the cantilever portion has a spiral shape in which the curved part curves about an axis of curvature that varies in orientation over a length of the curved part.

46. A method according to claim 44 wherein introducing stress that is concentrated at the orientation that forms the oblique angle with the longitudinal direction comprises fabricating corresponding posts to have shapes which provide at least one side which, prior to bending of the cantilever portion, extends the orientation that forms the oblique angle with the longitudinal direction.

47. A method according to claim 38 comprising fabricating an antenna conductor which extends along at least a portion of the cantilever portion.

48. An antenna array of comprising a plurality of antennas lithographically fabricated on the same substrate and having different elevation angles, each antenna capable of self-assembly to extend in a corresponding out-of-plane direction corresponding to its elevation angle, each antenna comprising:

a cantilever arm anchored to the substrate at one of its ends and fabricated to provide a cantilever portion that extends from the anchor in a longitudinal direction that is generally parallel to the substrate, the cantilever portion spaced apart from the substrate;

a plurality of posts fabricated atop the cantilever portion at locations spaced apart from one another in the longitudinal direction, each post shrinking from a first post volume to a second post volume, less than the first post volume, during fabrication thereof and wherein shrinking in volume of the posts from the first post volume to the second post volume causes stress between the posts and the cantilever arm, the stress causing, at least in part, the cantilever portion to bend from the in-plane orientation to a self-assembled orientation extending in its corresponding out-of-plane direction; and an antenna conductor which extends along at least a portion of the cantilever portion.

49. An antenna array according to claim 48 wherein each antenna comprises one or more spans, each span extending between longitudinally adjacent posts at a location spaced apart from the cantilever arm and each span shrinking from a first span volume to a second span volume, less than the first span volume, during fabrication thereof and wherein shrinking in volume of each span from its first span volume to its second span volume causes span-induced stress on the cantilever portion, the span-induced stress causing, at least in part, the cantilever portion to bend from the in-plane orientation to the self-assembled orientation.

50. An antenna array according to claim 49 wherein the posts and the spans are fabricated from a polymer and the shrinking in volume of the posts from the first post volume to the second post volume and the shrinking in volume of the spans from the first span volume to the second span volume are associated with curing of the polymer.

51. An antenna array according to claim 49 wherein, for each antenna, the self-assembled orientation comprises an orientation wherein a curved part of the cantilever portion curves away from the substrate and a straight part of the cantilever portion extends in a generally straight direction, the straight direction extending in the antenna's corresponding out-of-plane direction.

* * * * *